US008580003B2

(12) United States Patent
Mitsuda

(10) Patent No.: US 8,580,003 B2
(45) Date of Patent: Nov. 12, 2013

(54) EXHAUST GAS PURIFYING DEVICE

(75) Inventor: Masataka Mitsuda, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 330 days.

(21) Appl. No.: 12/737,897

(22) PCT Filed: Sep. 7, 2009

(86) PCT No.: PCT/JP2009/065598

§ 371 (c)(1),
(2), (4) Date: Mar. 25, 2011

(87) PCT Pub. No.: WO2010/032644

PCT Pub. Date: Mar. 25, 2010

(65) Prior Publication Data

US 2011/0167775 A1 Jul. 14, 2011

(30) Foreign Application Priority Data

Sep. 18, 2008 (JP) ..... 2008-239408

(51) Int. Cl.

| | |
|---|---|
| ***B01D 50/00*** | (2006.01) |
| ***F01N 3/021*** | (2006.01) |
| ***F01N 3/10*** | (2006.01) |

(52) U.S. Cl.

USPC ..... 55/318; 55/482; 55/DIG. 30; 60/299; 60/311; 428/180; 428/222

(58) Field of Classification Search

USPC ..... 55/482, DIG. 30, 315, 318; 422/179, 422/180, 181, 221, 222; 60/299, 311

See application file for complete search history.

(56) References Cited

U.S. PATENT DOCUMENTS

| | | | | |
|---|---|---|---|---|
| 6,767,378 | B2 | 7/2004 | Nishiyama et al. | |
| 7,047,731 | B2 * | 5/2006 | Foster et al. | 60/297 |
| 7,779,624 | B2 * | 8/2010 | Belisle et al. | 60/299 |
| 8,246,709 | B2 * | 8/2012 | Franken | 55/503 |
| 2006/0067860 | A1 * | 3/2006 | Faircloth et al. | 422/171 |
| 2009/0031717 | A1 * | 2/2009 | Blaisdell | 60/324 |
| 2010/0086446 | A1 | 4/2010 | Matsunaga et al. | |
| 2011/0023472 | A1 * | 2/2011 | Saito et al. | 60/311 |
| 2011/0138794 | A1 * | 6/2011 | Yamamoto | 60/311 |
| 2011/0154809 | A1 * | 6/2011 | Mitsuda et al. | 60/311 |
| 2011/0154810 | A1 * | 6/2011 | Mitsuda et al. | 60/311 |
| 2011/0155263 | A1 * | 6/2011 | Mitsuda et al. | 137/343 |
| 2011/0167807 | A1 * | 7/2011 | Mitsuda | 60/311 |
| 2011/0192671 | A1 * | 8/2011 | Mitsuda et al. | 180/309 |

FOREIGN PATENT DOCUMENTS

| | | |
|---|---|---|
| JP | 49-130135 | 11/1974 |
| JP | 52-035302 | 8/1977 |
| JP | 2000-145430 | 5/2000 |
| JP | 2001-098926 | 4/2001 |

(Continued)

*Primary Examiner* — Robert Clemente
(74) *Attorney, Agent, or Firm* — Jordan and Hamburg LLP

(57) ABSTRACT

Provided is an exhaust gas purifying device structured such that a gas sensor or the like can be easily arranged while an installation length of gas purifying filters can be formed compact. The exhaust gas purifying device includes the gas purifying filters for purifying an exhaust gas discharged from an engine, inner cases internally provided with the gas purifying filters, and outer cases internally provided with the inner cases. Provided are sets of the gas purifying filters, the inner cases and the outer cases, and flange bodies connecting plural sets of outer cases are offset with respect to a connection boundary position of plural sets of gas purifying filters.

4 Claims, 27 Drawing Sheets

(56) References Cited

FOREIGN PATENT DOCUMENTS

| | | |
|---|---|---|
| JP | 2001-173429 | 6/2001 |
| JP | 2003-027922 | 1/2003 |
| JP | 2004-263593 | 9/2004 |
| JP | 2005-016374 | 1/2005 |
| JP | 2005-194949 | 7/2005 |
| JP | 2008-082201 | 4/2008 |
| JP | 4115120 | 7/2008 |

* cited by examiner

EXHAUST GAS PURIFYING DEVICE

TECHNICAL FIELD

The present invention relates to an exhaust gas purifying device mounted on a diesel engine or the like, and more particularly to an exhaust gas purifying device removing a particulate matter (soot and particulate) or a nitrogen oxide (NOx) included in an exhaust gas.

BACKGROUND OF THE INVENTION

Conventionally, in an exhaust gas purifying device applied to a diesel engine or the like, there has been a technique that a diesel particulate filter (or an NOx catalyst) or the like is provided in an exhaust gas discharge route of the diesel engine mounted to a traveling machine body or the like, and the exhaust gas discharged out of the diesel engine is purified by the diesel particulate filter (or the NOx catalyst) or the like (Patent Document 1, Patent Document 2, and Patent Document 3). Further, there has been known a technique in which a filter case (an inner case) is provided within a casing (an outer case), and a particulate filter is arranged within the filter case (see Patent Document 4).

CITATION LIST

Patent Document 1: Japanese Patent Application Laid-open No. 2000-145430

Patent Document 2: Japanese Patent Application Laid-open No. 2003-27922

Patent Document 3: Japanese Patent Application Laid-open No. 2008-82201

Patent Document 4: Japanese Patent Application Laid-open No. 2001-173429

SUMMARY OF THE INVENTION

In a structure in which a plurality of casings are respectively internally provided with a plurality of particulate filters, and a maintenance of a plurality of particulate filters can be carried out by disassembling a plurality of casings, if a flange body connecting a plurality of casings is arranged in a mating face of a plurality of particulate filters, a sensor mounting boss body supporting a gas sensor is necessary in the case that the gas sensor is provided in the mating face of a plurality of particulate filters. In a structure in which the sensor mounting boss body is welded to the casing, it is necessary to separate the flange body and the sensor mounting boss body. In other words, it is necessary to enlarge a dimension of the casing in a gas moving direction of the particulate filter in comparison with a dimension necessary for installing a plurality of particulate filter, which accordingly causes a problem that a useless space is formed.

Further, in a structure provided with a plurality of filter cases (inner cases) each internally provided with a gas purifying filter, and a plurality of casings (outer cases) each internally provided with the filter case, in the case that each of the casings is connected in such a manner as to be separable, a flange is arranging in a mating face (a joint surface) of each of the gas purifying filters. In other words, an end face of the filter case such as a soot filter or the like becomes flush with an end face of the outer case, and an exposure range of the filter case from the casing is small. Therefore, there is a problem that a maintenance work such as a soot removal or the like cannot be easily executed. In addition, for example, in the case that the particulate filter is mounted to the diesel engine, an oscillation (a deforming stress) of the diesel engine is transmitted to the particulate filter within the inner case from the outer case. The outer case, the inner case, the particulate filter, or the support portion thereof may be deformed and damaged by the oscillation (the deforming stress), causing a reduction of a sealing performance or the like and accordingly a problem that it is difficult to improve a durability of the particulate filter.

Further, in the structure in which the particulate filter is arranged within the casing, in the case that an exhaust gas from an engine is input to the casing having the cylindrical shape from a shear direction which is orthogonal to a center line of the cylindrical shape, the structure is made such that the exhaust gas from the engine is uniformly supplied to an end face of the particulate filter, by forming an inlet pipe for the exhaust gas from the engine as a taper tube shape, or forming a greater space than the particulate filter case in the casing side so as to insert a punching hole forming portion of the inlet pipe for the exhaust gas from the engine toward the center of the casing space. For example, in the case that the inlet pipe is formed as the taper tube shape, a gradient of the taper tube is limited. Therefore, there is a problem that a length of the inlet pipe cannot be made shorter or the like. On the other hand, in the case that the inlet pipe is inserted toward the center of the casing space, a dimension in an exhaust gas movement upstream side along the casing (a dimension in a moving direction of the exhaust gas) cannot be made shorter. Therefore, there is a problem that the casing or the inlet pipe cannot be formed compact. Further, since the pipe member (the inlet pipe) inserted to the casing cannot be omitted, there is a problem that it is difficult to easily shorten the length in the exhaust gas moving direction of the casing on the exhaust gas upstream side of the particulate filter.

Accordingly, an object of the present invention is to provide an exhaust gas purifying device which dissolves the problems mentioned above.

In order to achieve the object mentioned above, in accordance with a first aspect of the present invention, there is provided an exhaust gas purifying device including: a gas purifying filter for purifying an exhaust gas exhausted from an engine; an inner case internally provided with the gas purifying filter; and an outer case internally provided with the inner case, wherein plural sets of the gas purifying filters, the inner cases, and the outer cases are provided, and a flange body connecting a plurality of outer cases is offset with respect to a connection boundary position of a plurality of gas purifying filters.

In accordance with a second aspect of the present invention, there is provided an exhaust gas purifying device as recited in the first aspect, wherein in a structure in which two kinds of the gas purifying filters are provided, the inner case internally provided with one of the gas purifying filters is overlapped by the outer case internally provided with the inner case of the other gas purifying filter.

In accordance with a third aspect of the present invention, there is provided an exhaust gas purifying device as recited in the first aspect, wherein in a structure in which an inner case support body having a ring shape is provided between the inner case and the outer case, the inner case support body is formed by a flexible material having a vibration damping function, and the inner case is supported to the outer case via the inner case support body.

In accordance with a fourth aspect of the present invention, there is provided an exhaust gas purifying device as recited in the first aspect, wherein an exhaust noise damping body for damping an exhaust noise of the exhaust gas discharged from the engine is provided, and the exhaust noise damping body is arranged in an exhaust gas outlet side end portion of the outer case.

In accordance with a fifth aspect of the present invention, there is provided an exhaust gas purifying device as recited in the first aspect, wherein an inlet pipe is arranged on an outer side of the outer case, an exhaust gas inlet is open to the inner case and the outer case so as to be opposed to an exhaust gas outlet side of the inlet pipe, a rectifying chamber is formed between an end face of the outer case and an end face of the gas purifying filter on an upstream side in an exhaust gas moving direction along the outer case, and the rectifying chamber is communicated with the inlet pipe via the exhaust gas inlet.

In accordance with a sixth aspect of the present invention, there is provided an exhaust gas purifying device as recited in the first aspect, wherein an exhaust gas inlet is formed in a peripheral surface close to one end of the inner case and the outer case, an inlet pipe is arranged on an outer side of the exhaust gas inlet in an outer periphery of the outer case, and an area of an opening end face close to an exhaust gas outlet of the inlet pipe is formed larger than an area of an opening end face close to the exhaust gas inlet of the inlet pipe.

In accordance with a seventh aspect of the present invention, there is provided an exhaust gas purifying device as recited in the first aspect, wherein the inner case is connected to the outer case, and an inlet component part or a support body to which an external stress is applied is arranged in the outer case.

In accordance with the first aspect of the present invention, in the exhaust gas purifying device having the gas purifying filter for purifying the exhaust gas discharged from the engine, the inner case internally provided with the gas purifying filter, and the outer case internally provided with the inner case, wherein the plural sets of the gas purifying filters, the inner cases, and the outer cases are provided, and the flange body connecting a plurality of outer cases is offset with respect to the connection boundary position of a plurality of gas purifying filters. Therefore it is possible to shorten a distance of the connection portions of a plurality of gas purifying filters, and accordingly to shorten a connection length of a plurality of outer cases. Further, it is possible to easily arrange a gas sensor or the like at the connection boundary position of a plurality of gas purifying filters. Since it is possible to shorten a length of a plurality of outer cases in the exhaust gas moving direction, it is possible to achieve an improvement of a rigidit, and a weight saving of the outer case or the like.

In accordance with the second aspect of the present invention, since the exhaust gas purifying device has the structure in which two kinds of the gas purifying filters are provided, the inner case internally provided with one of the gas purifying filters is overlapped by the outer case internally provided with the inner case of the other gas purifying filter, it is possible to shorten the length of the plural sets of outer cases in the exhaust gas moving direction while securing the length of a plurality of gas purifying filters in the exhaust gas moving direction. Further, since the inner case (the other of the gas purifying filters) over which the outer case laps is greatly exposed to outside on the basis of a separation (a disassembly) of each of the outer cases, an exposing range of the inner case (the other of the gas purifying filters) becomes larger, making it possible to easily execute a maintenance work such as a removal of a soot of one of the gas purifying filters.

In accordance with the third aspect of the present invention, since the exhaust gas purifying device has the structure in which the inner case support body having the ring shape is provided between the inner case and the outer case, the inner case support body is formed by the flexible material having the vibration damping function, and the inner case is supported to the outer case via the inner case support body, the vibration of the outer case is damped by the inner case support body, reducing the vibration transmitted from the outer case to the inner case, and consequently making it possible to easily prevent a reduction of a sealing performance of the gas purifying filter, and a damage or a dropout of the outer case, the inner case, or the gas purifying filter. In other words, it is possible to reduce a reduction of the sealing performance of the outer case or the inner case, and to improve a durability of the gas purifying filter. Further, for example, even in the filter structure in which an exhaust gas purifying capacity is enhanced by combining a plurality of the gas purifying filters, it is possible to easily improve a maintenance workability of the gas purifying filter.

In accordance with the fourth aspect of the present invention, since the exhaust gas purifying device includes the exhaust noise damping body for damping the exhaust noise of the exhaust gas discharged from the engine, the exhaust noise damping body arranged in the exhaust gas outlet side end portion of the outer case, it is possible to easily add an exhaust gas noise reduction function without changing the structure of the gas purifying filter, while maintaining the exhaust gas purifying function of the gas purifying filter. For example, it is possible to easily construct an exhaust gas structure in which a tail pipe is directly connected to the outer case, and an exhaust gas structure which further improves a noise reduction function of the existing silencer. Further, it is possible to easily execute a high frequency reduction countermeasure of the exhaust gas which has been hard to be executed by the gas purifying filter. For example, it is possible to easily install the exhaust noise damping body formed by a punch hole and a fiber type mat or the like.

In accordance with the fifth aspect of the present invention, since the exhaust gas purifying device has the structure in which the inlet pipe is arranged on the outer side of the outer case, the exhaust gas inlet is open to the inner case and the outer case so as to be opposed to the exhaust gas outlet side of the inlet pipe, the rectifying chamber is formed between the end face of the outer case and the end face of the gas purifying filter on the upstream side in the exhaust gas moving direction along the outer case, and the rectifying chamber is communicated with the inlet pipe via the exhaust gas inlet, it is not necessary to insert the inlet pipe to the rectifying chamber, for example, in a structure in which the exhaust gas from the engine is input to the inner case and the outer case from a shear direction which is orthogonal to the center line thereof. Accordingly, it is possible to achieve cost reduction by reducing the number of the component parts of the outer case structure provided with the inlet pipe, and to easily shorten the length in the exhaust gas moving direction of the inner case and the outer case on the exhaust gas upstream side along the gas purifying filter. In other words, it is possible to easily shorten a relative distance between the exhaust gas inlet side of the gas purifying filter, and the upstream side end face in the exhaust gas moving direction along the inner case and the outer case which are opposed to the exhaust gas inlet side of the gas purifying filter. The gas purifying filter can be arranged so as to be close to the inner case and the outer case end face on the exhaust gas moving upstream side, the number of the parts can be made smaller than the conventional one by shortening the dimension of the inner case and the outer case in the exhaust gas moving direction, whereby it is possible to construct the exhaust gas purifying device compact and low in weight at a low cost.

In accordance with the sixth aspect of the present invention, since the exhaust gas inlet is formed on the peripheral surface close to one end of the inner case and the outer case, the inlet pipe is arranged on the outer side of the exhaust gas inlet in the outer periphery of the outer case, and the area of the opening end face close to the exhaust gas outlet of the inlet pipe is formed larger than the area of the opening end face close to the exhaust gas inlet of the inlet pipe, the exhaust gas inlet pipe can be arranged close to the gas purifying filter installation portion, making it possible to easily shorten the length, in the exhaust gas moving direction, of the outer case (the casing) on the exhaust gas upstream side along the gas purifying filter. In other words, it is possible to arrange the end face of the gas purifying filter close to the end face on the upstream side in the exhaust gas moving direction of the outer case. Further, it is possible to weld the inlet pipe to the outer peripheral surface of the outer case, by forming the area of the opening end face close to the exhaust gas outlet side of the inlet pipe larger than the area of the opening end face close to the exhaust gas inlet side of the inlet pipe, and it is possible to lower an exhaust gas pressure loss in the outer case and the inlet pipe, while maintaining a mounting strength of the inlet pipe on the exhaust gas inlet side of the outer case, without provision of the reinforcing member for connecting the outer case and the inlet pipe as in a conventional technique.

In accordance with the seventh aspect of the present invention, since the inner case is connected to the outer case, and the inlet component part or the support body to which the external stress is applied is arranged in the outer case, it is possible to support an external stress by the outer case and to reduce the external stress acting as a deforming force on the inner case. In addition that it is possible to improve a heat insulating property of the gas purifying filter on the basis of a double structure of the inner case and the outer case so as to improve a processing capacity and a regenerating capacity of the gas purifying filter, it is possible to easily prevent a support of the gas purifying filter from being inappropriate, for example, due to a transmission of the vibration from the engine, a strain of a welding process, or the like.

DESCRIPTION OF THE PREFERRED EMBODIMENTS

Figure 1:
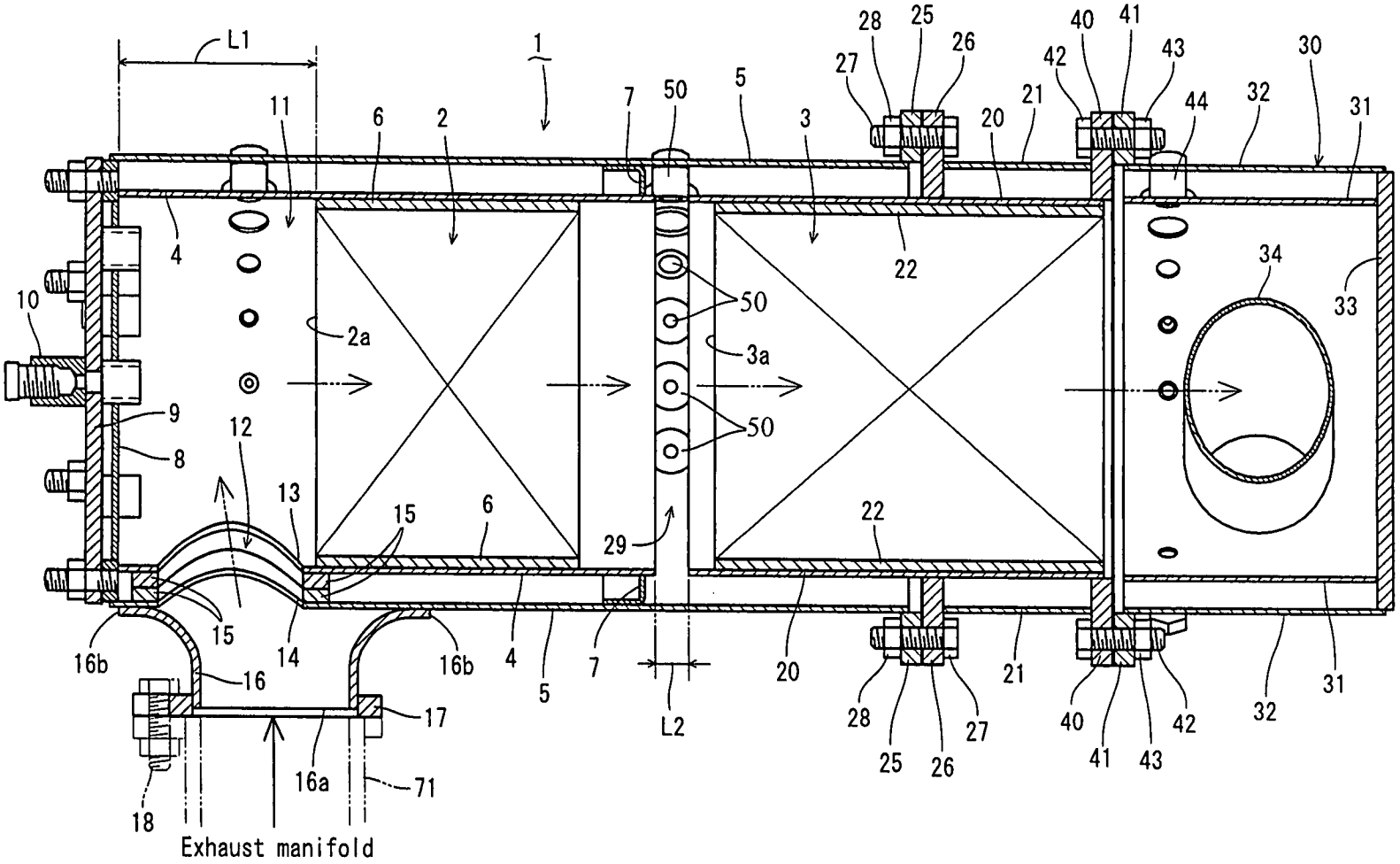
FIG. 1 is a cross sectional view in a front view of an exhaust gas purifying device in accordance with an embodiment of the present invention.
Figure 2:
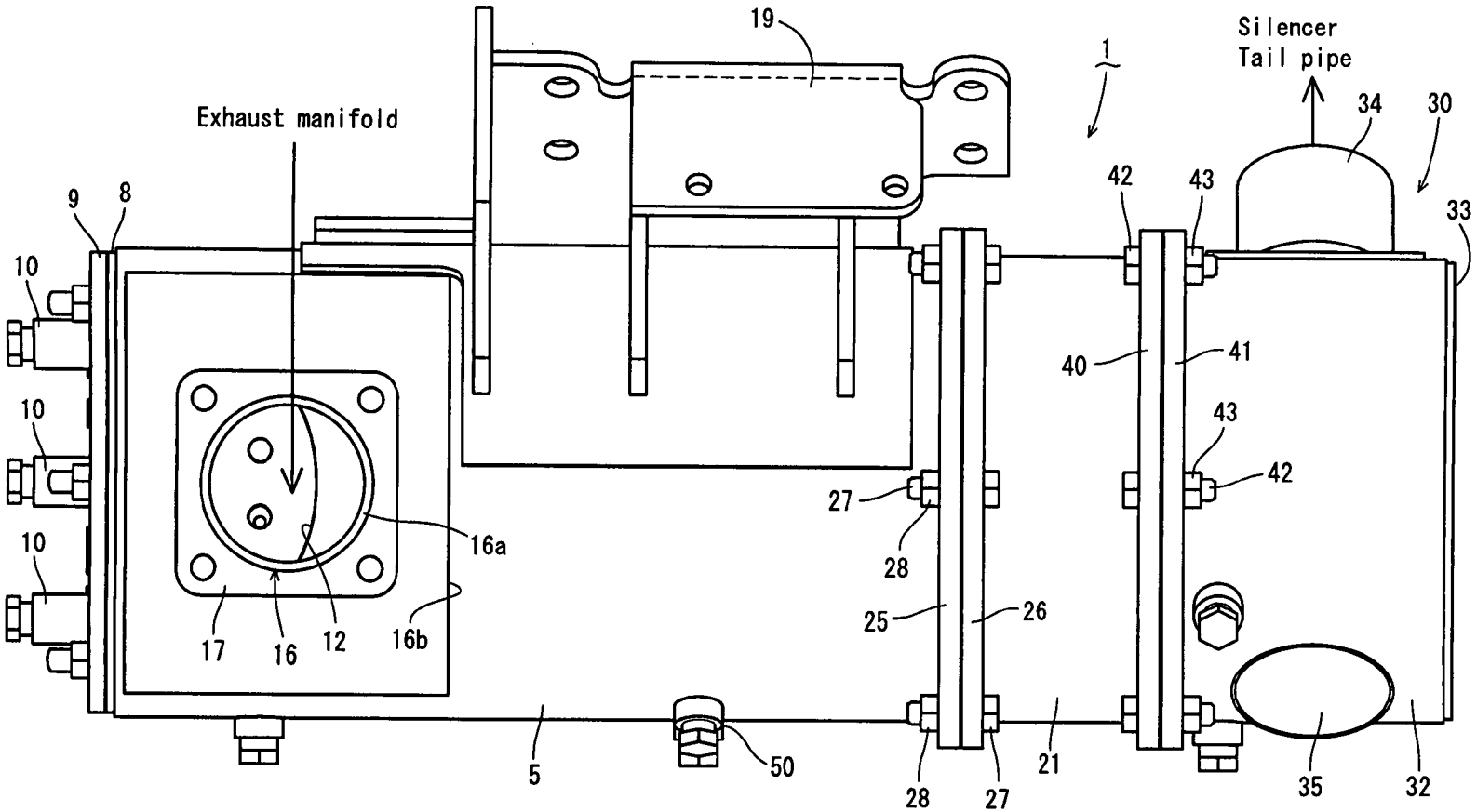
FIG. 2 is a bottom elevational view of an outer appearance of the same.
Figure 3:
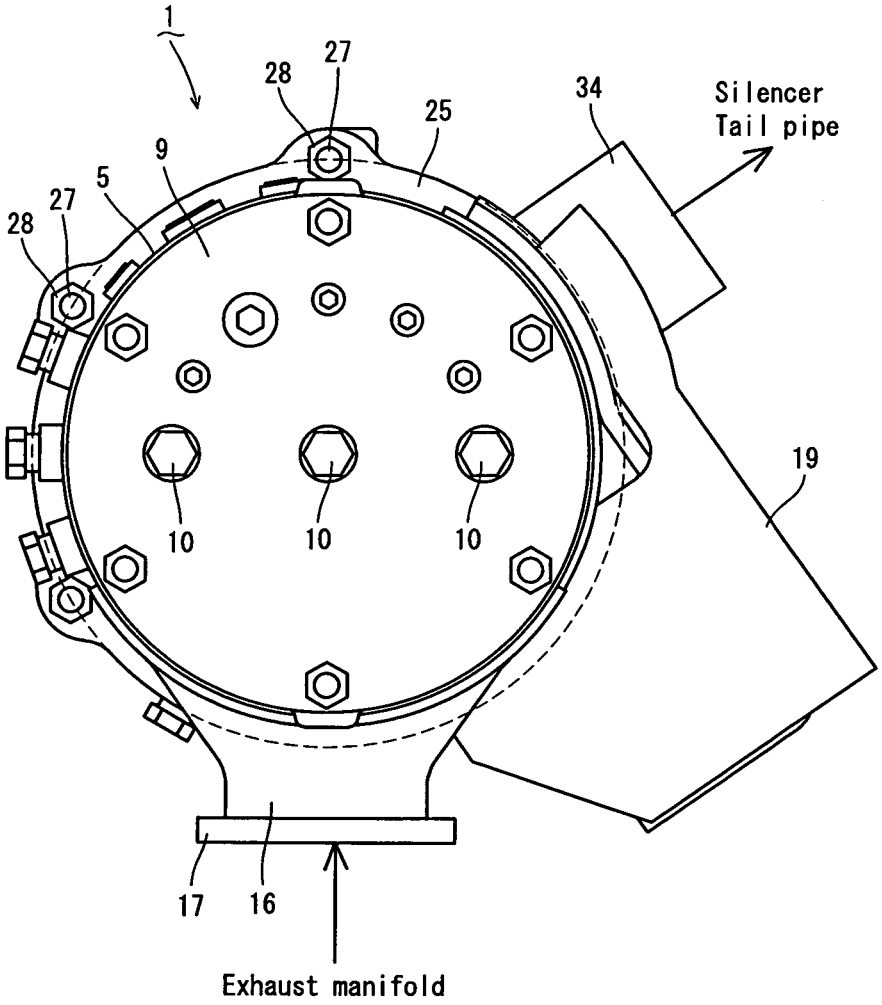
FIG. 3 is a left side elevational view as seen from an exhaust gas inflow side of the same.
Figure 4:
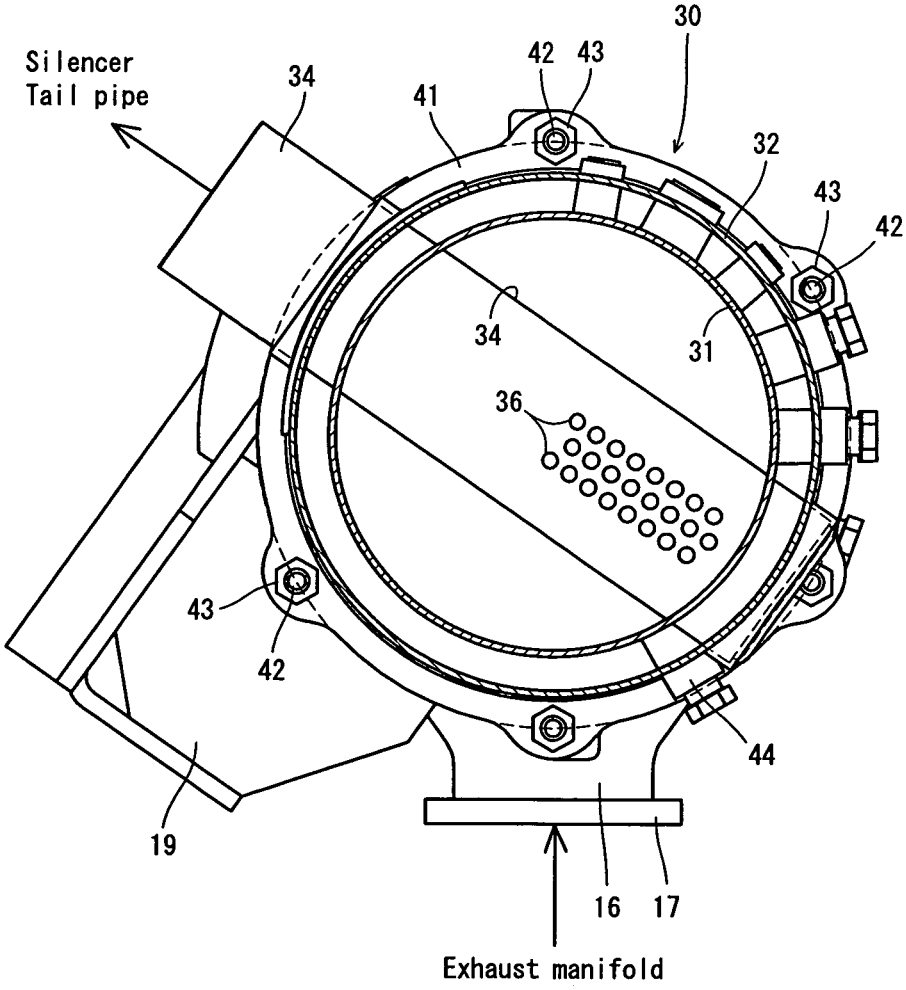
FIG. 4 is a right side elevational view as seen from an exhaust gas discharge side of the same.
Figure 5:
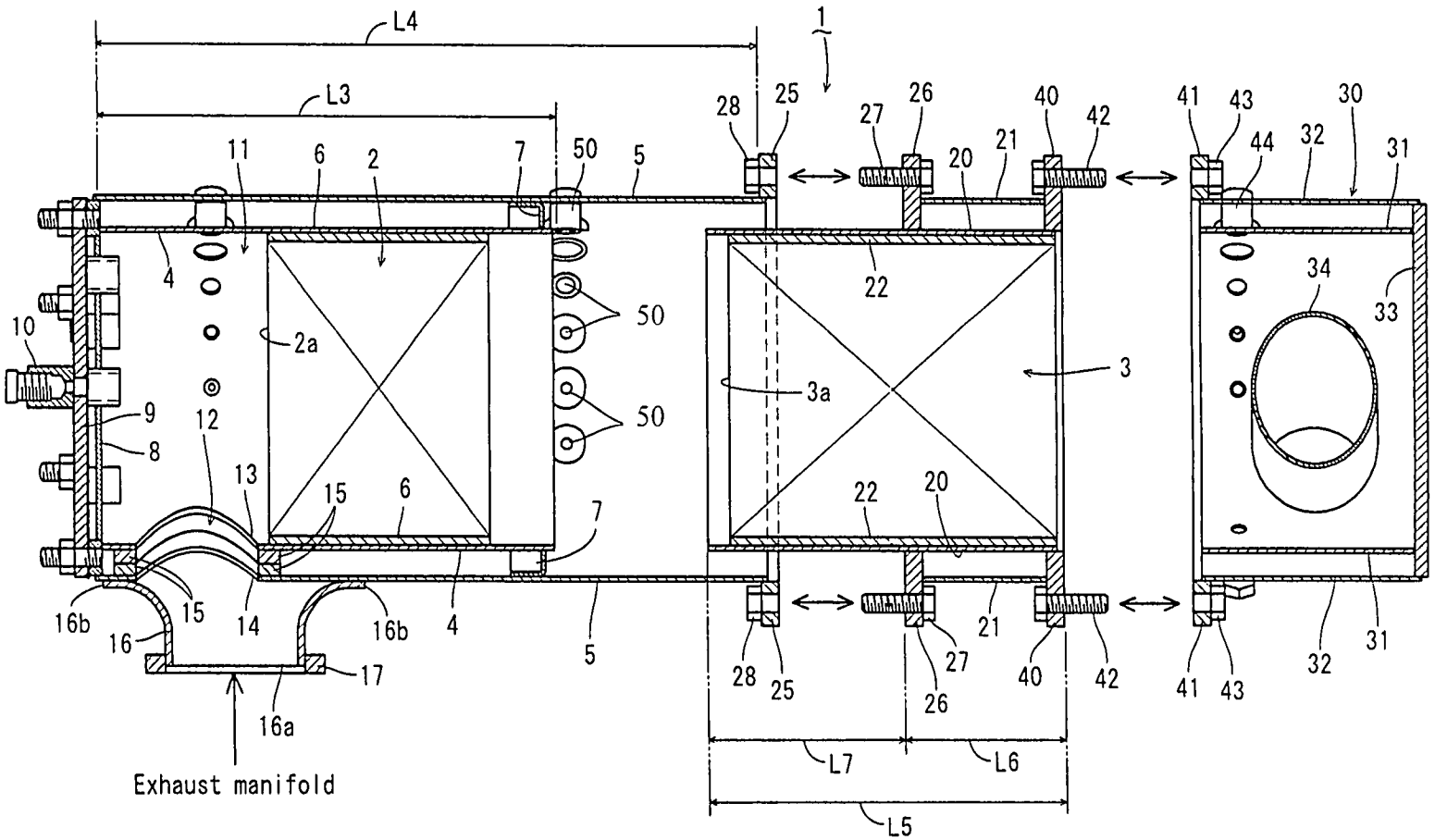
FIG. 5 is an exploded cross sectional view in a front view of FIG. 1.
Figure 6:
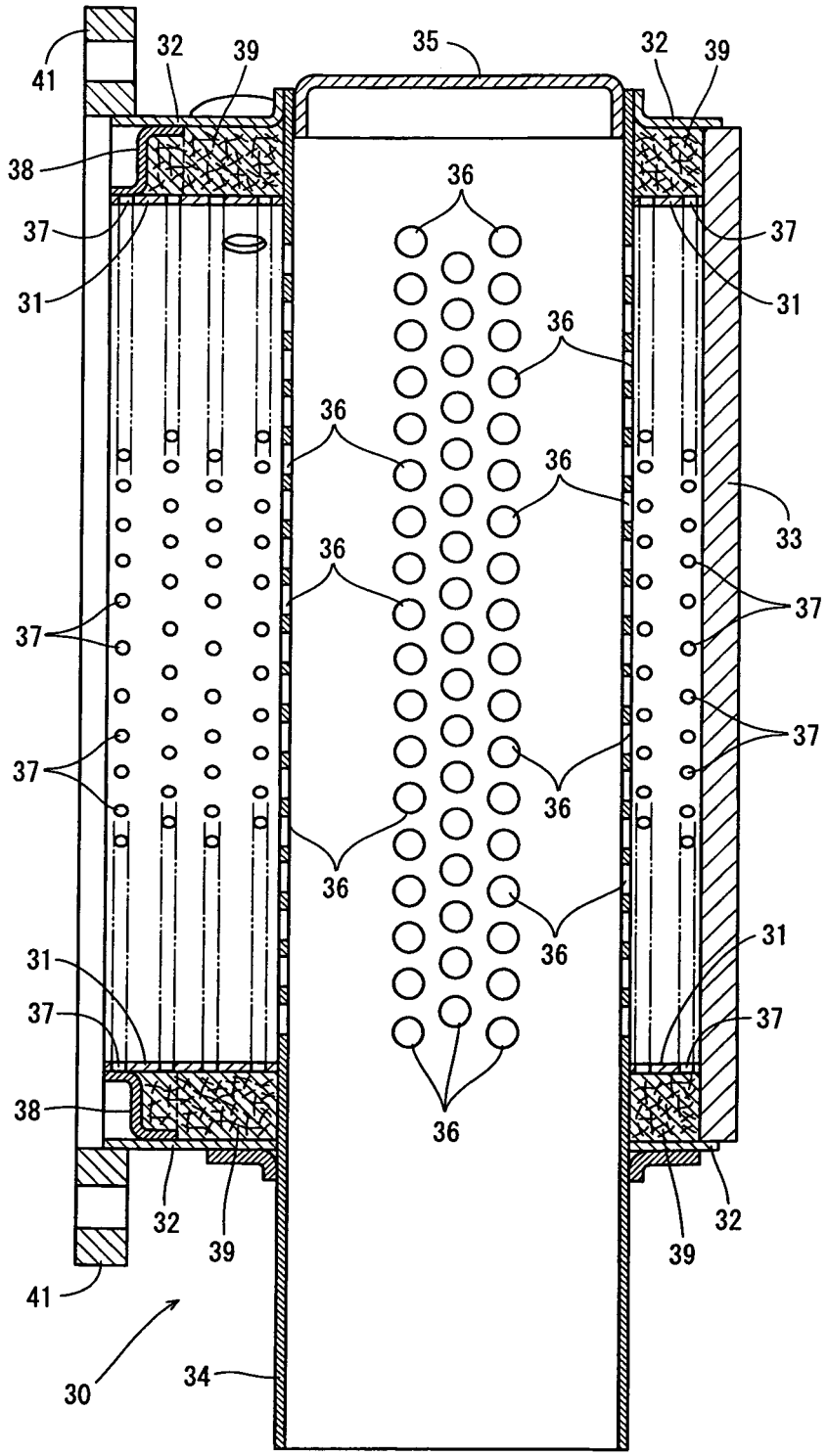
FIG. 6 is an enlarged cross sectional view in a front view of the exhaust gas discharge side of the same.
Figure 7:
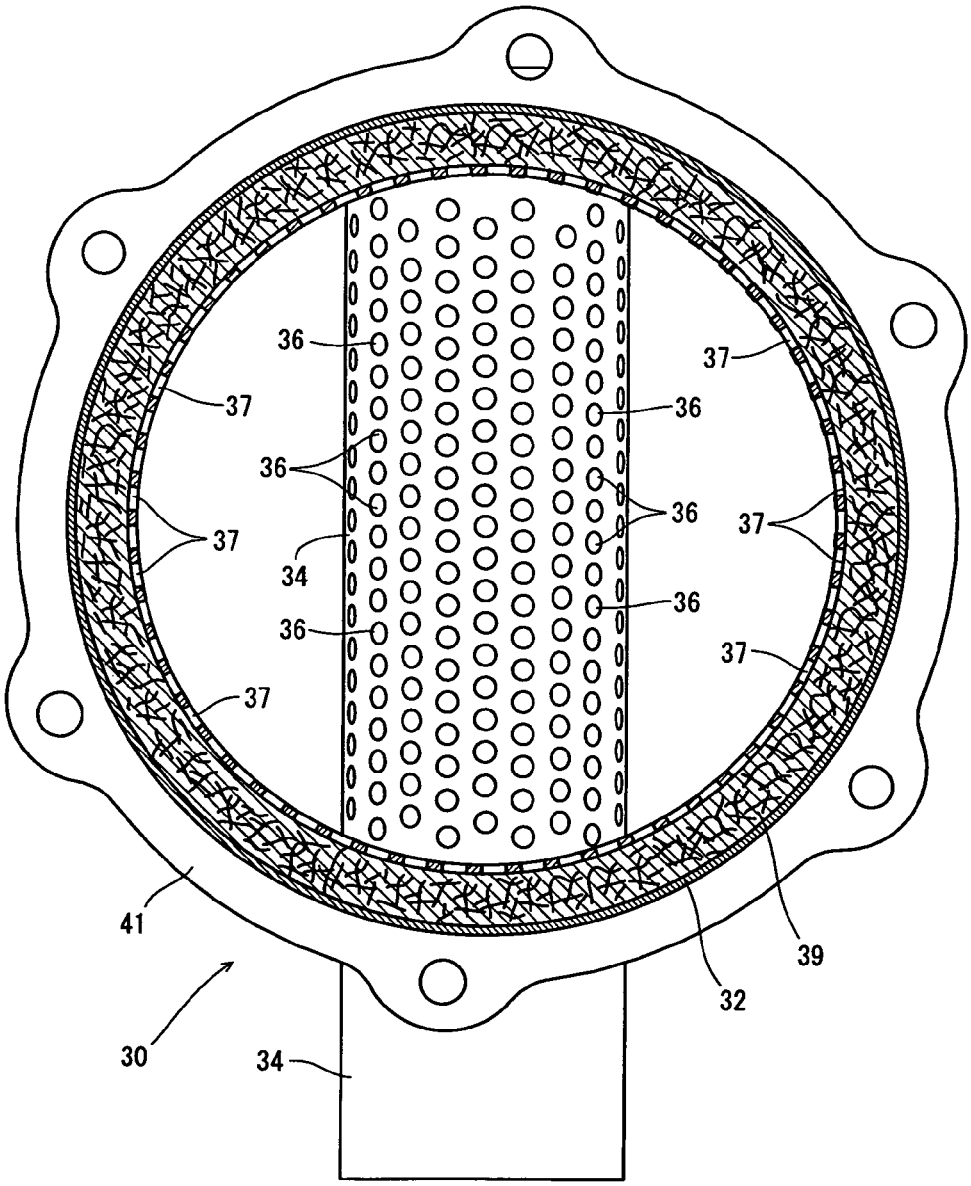
FIG. 7 is an enlarged cross sectional view in a side elevational view of the exhaust gas discharge side of the same.
Figure 8:
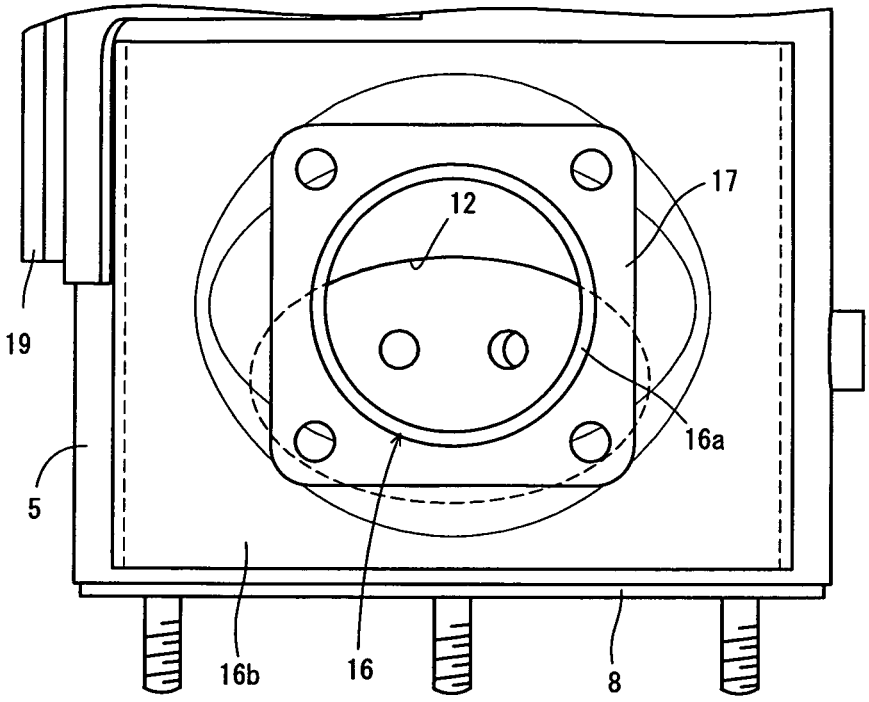
FIG. 8 is an enlarged bottom elevational view of the exhaust gas inflow side of the same.
Figure 9:
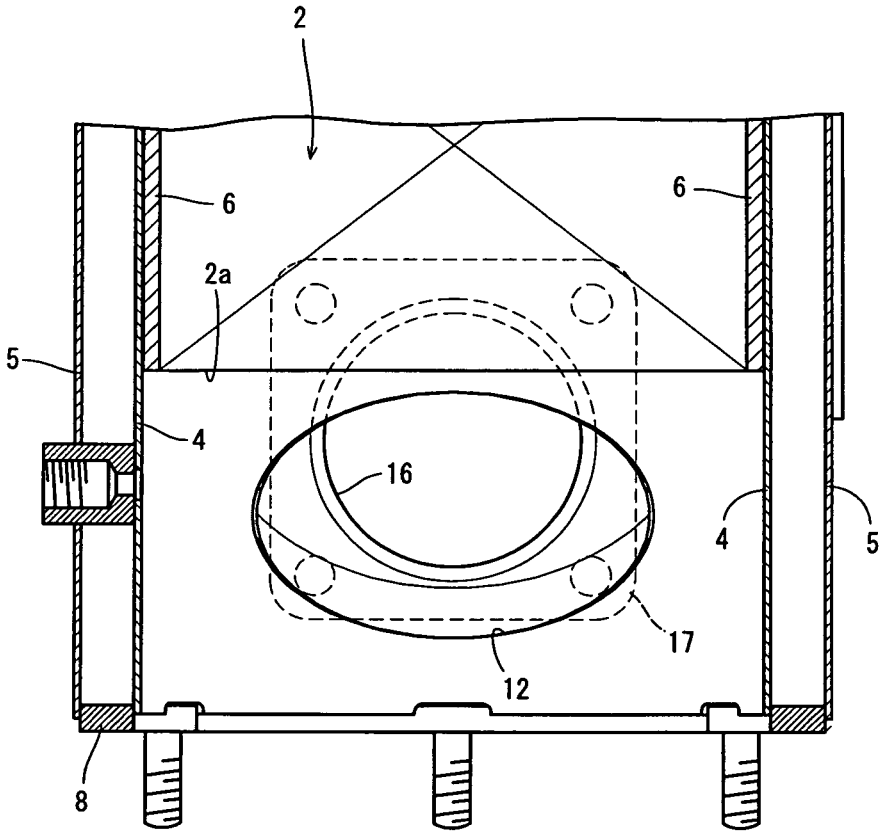
FIG. 9 is an enlarged cross sectional view in a plan view of the exhaust gas inflow side of the same.

An embodiment obtained by specifying the present invention will be described below with reference to the accompanying drawings. FIG. 1 is a cross sectional view in a front view of an exhaust gas purifying device, FIG. 2 is a bottom elevational view of an outer appearance of the same, FIG. 3 is a left side elevational view as seen from an exhaust gas inflow side of the same, FIG. 4 is a right side elevational view as seen from an exhaust gas discharge side of the same, FIG. 5 is an exploded cross sectional view in a front view of FIG. 1, FIG. 6 is an enlarged cross sectional view in a front view of the exhaust gas discharge side of the same, FIG. 7 is an enlarged cross sectional view in a side elevational view of the exhaust gas discharge side of the same, FIG. 8 is an enlarged bottom elevational view of the exhaust gas inflow side of the same, and FIG. 9 is an enlarged cross sectional view in a plan view of the exhaust gas inflow side of the same. A whole structure of the exhaust gas purifying device will be described with reference to FIGS. 1 to 5. In the following description, the exhaust gas inflow side is called simply as a left side, and the exhaust gas discharge side is called simply as a right side, in the same manner.

As shown in FIGS. 1 to 5, there is provided a continuous reproduction type diesel particulate filter 1 (hereinafter, refer to as DPF) serving as an exhaust gas purifying device in accordance with the present embodiment. The DPF 1 is provided for physically collecting a particulate matter (PM) or the like in the exhaust gas. The DPF 1 is structured such that a diesel oxidation catalyst 2 such as a platinum or the like generating a nitrogen dioxide (NO2), and a soot filter 3 in a honeycomb structure continuously oxidizing and removing the collected particulate matter (PM) at a comparatively low temperature are arranged in series in a moving direction of the exhaust gas (a direction from a left side to a right side in FIG. 1). DPF 1 is structured such that the soot filter 3 is continuously reproduced. By the DPF 1, it is possible to reduce a carbon oxide (CO) and a hydro carbon (HC) in the exhaust gas, in addition to the removal of the particulate matter (PM) in the exhaust gas.

A mounting structure of the diesel oxidation catalyst 2 will be described with reference to FIGS. 1 and 5. As shown in FIGS. 1 and 5, the diesel oxidation catalyst 2 serving as the gas purifying filter for purifying the exhaust gas discharged from the engine is provided inside an approximately tubular catalyst inner case 4 made of a heat resisting metal material. The catalyst inner case 4 is provided inside an approximately tubular catalyst outer case 5 made of a heat resisting metal material. In other words, the catalyst inner case 4 is fitted to an outer side of the diesel oxidation catalyst 2 via a catalyst heat insulating material 6 having a mat shape and made of a ceramic fiber. Further, the catalyst outer case 5 is fitted to an outer side of the catalyst inner case 4 via a support body 7 having an I-shaped end face and made of a thin plate. In this structure, the diesel oxidation catalyst 2 is protected by the catalyst heat insulating material 6. A stress (a deforming force) of the catalyst outer case 5 transmitted to the catalyst inner case 4 is reduced by the thin plate support body 7.

As shown in FIGS. 1 and 5, a disc-like left lid body 8 is firmly fixed, by welding, to a left end portion of the catalyst inner case 4 and the catalyst outer case 5. A sensor connection plug 10 is firmly fixed to the left lid body 8 via a seat plate body 9. A left end face 2*a* of the diesel oxidation catalyst 2 and the left lid body 8 are opposed so as to be spaced only at a fixed distance L1 for a gas inflow space. An exhaust gas inflow space 11 is formed between the left end face 2*a* of the diesel oxidation catalyst 2 and the left lid body 8. In this case, an inlet side exhaust gas pressure sensor, an inlet side exhaust gas temperature sensor and the like (which are not illustrated) are connected to the sensor connection plug 10.

As shown in FIGS. 1, 5 and 9, an exhaust gas inflow port 12 having an oval shape is open to a left end portion of the catalyst inner case 4 and the catalyst outer case 5 in which an exhaust gas inflow space 11 is formed. The exhaust gas inflow port 12 having the oval shape is formed in such a manner that an exhaust gas moving direction (a direction of center lines of the cases 4 and 5) is a short diameter, and a direction which is orthogonal to the exhaust gas moving direction (a circumferential direction of the cases 4 and 5) is a long diameter. An occlusion ring body 15 is firmly fixed so as to be pinched between an open edge 13 of the catalyst inner case 4 and an open edge 14 of the catalyst case 5. A gap between the open edge 13 of the catalyst inner case 4 and the open edge 14 of the catalyst outer case 5 is closed by the occlusion ring body 15. The occlusion ring body 15 prevents the exhaust gas from flowing into the portion between the catalyst inner case 4 and the catalyst outer case 5.

As shown in FIGS. 1, 3, 5 and 8, an exhaust gas inlet pipe 16 is arranged on an outer surface of the catalyst outer case 5 in which the exhaust gas inflow port 12 is formed. An exhaust gas connection flange body 17 is welded to a complete round shaped open end portion 16*a* close to a small diameter in the exhaust gas inlet pipe 16. The exhaust gas connection flange body 17 is fastened to an exhaust gas manifold 71 of a diesel engine 70 mentioned below, with a bolt 18. A complete round shaped open end portion 16*b* close to a large diameter in the exhaust gas inlet pipe 16 is welded to an outer surface of the catalyst outer case 5. The exhaust gas inlet pipe 16 is formed as a divergent shape (a trumpet shape) from the complete round shaped open end portion 16*a* close to the small diameter toward the complete round shaped open end portion 16*b* close to the large diameter.

As shown in FIGS. 1, 5 and 8, a left end portion of the complete round shaped open end portion 16*b* close to the large diameter is welded to an outer surface of a left end portion of the open edge 14 of the catalyst outer case 5, in the outer surface of the catalyst outer case 5. In other words, the exhaust gas inlet pipe 16 (the complete round shaped open end portion 16*b* close to the large diameter side) is arranged with respect to the oval shaped exhaust gas inflow port 12 so as to be offset to an exhaust gas movement downstream side (a right side of the catalyst outer case 5). In other words, the oval shaped exhaust gas inflow port 12 is formed in the catalyst outer case 5 with respect to the exhaust gas inlet pipe 16 (the complete round shaped open end portion 16*b* close to the large diameter) so as to be offset to an exhaust gas movement upstream side (a left side of the catalyst outer case 5).

On the basis of the structure mentioned above, the exhaust gas of the engine 70 enters into the exhaust gas inlet pipe 16 from the exhaust gas manifold 71, enters into the exhaust gas inflow space 11 from the exhaust gas inlet pipe 16 via the exhaust gas inflow port 12, and is supplied to the diesel oxidation catalyst 2 from the left end face 2*a* thereof. On the basis of an oxidation action of the diesel oxidation catalyst 2, the nitrogen dioxide (NO2) is generated. Further, as shown in FIGS. 2 to 4, a support leg body 19 is welded to an outer peripheral surface of the catalyst outer case 5. In the case that the DPF 1 is assembled in the engine 70, the catalyst outer case 5 is firmly fixed to a cylinder head 72 or the like of the engine 70 mentioned below via the support leg body 19.

A mounting structure of the soot filter 3 will be described with reference to FIGS. 1 and 5. As shown in FIGS. 1 and 5, the soot filter 3 serving as a gas purifying filter for purifying the exhaust gas discharged from the engine 70 is provided inside an approximately tubular filter inner case 20 made of a heat resisting metal material. The inner case 20 is provided inside an approximately tubular filter outer case 21 made of a heat resisting metal material. In other words, the filter inner case 20 is fitted to an outer side of the soot filter 3 via a filter heat insulating material 22 having a mat shape and made of a ceramic fiber. In this structure, the soot filter 3 is protected by the filter heat insulating material 22.

As shown in FIGS. 1 and 5, a catalyst side flange 25 is welded to an end portion on the exhaust gas movement downstream side (the right side) of the catalyst outer case 5. A filter side flange 26 is welded to an intermediate of the filter inner case 20 in the exhaust gas moving direction, and an end portion on the exhaust gas movement upstream side (the left side) of the filter outer case 21. A catalyst side flange 25, and a filter side flange 26 are detachably fastened by a bolt 27 and a nut 28. In this case, a diameter dimension of the cylindrical catalyst inner case 4, and a diameter dimension of the cylindrical filter inner case 20 are approximately the same dimension. Further, a diameter dimension of the cylindrical catalyst outer case 5, and a diameter dimension of the cylindrical filter outer case 21 are approximately the same dimension.

As shown in FIG. 1, in a state in which the filter outer case 21 is connected to the catalyst outer case 5 via the catalyst side flange 25 and the filter side flange 26, the end portion on the exhaust gas movement upstream side (the left side) of the filter inner case 20 stands face to face to the end portion on the exhaust gas movement downstream side (the right side) of the catalyst inner case 4 so as to be spaced at a fixed distance L2 for mounting a sensor. In other words, a sensor mounting space 29 is formed between the end portion on the exhaust gas movement downstream side (the right side) of the catalyst inner case 4 and the end portion on the exhaust gas movement upstream side (the left side) of the filter inner case 20. A sensor connection plug 50 is firmly fixed to the catalyst outer case 5 at a position of the sensor mounting space 29. A filter inlet side exhaust gas pressure sensor, a filter inlet side exhaust gas temperature sensor (a thermistor) and the like, which are not illustrated, are connected to the sensor connection plug 50.

As shown in FIG. 5, a cylinder length L4 of the catalyst outer case 5 in the exhaust gas moving direction is formed longer than a cylinder length L3 of the catalyst inner case 4 in the exhaust gas moving direction. A cylinder length L6 of the filter outer case 21 in the exhaust gas moving direction is formed shorter than a cylinder length L5 of the filter inner case 20 in the exhaust gas moving direction. The structure is made such that a length (L2+L3+L5) obtained by adding the fixed distance L2 of the sensor mounting space 29, the cylinder length L3 of the catalyst inner case 4, and the cylinder length L5 of the filter inner case 20 becomes approximately equal to a length (L4+L6) obtained by adding the cylinder length L4 of the catalyst outer case 5 and the cylinder length L6 of the filter outer case 21. The end portion on the exhaust gas movement upstream side (the left side) of the filter inner case 20 protrudes from the end portion on the exhaust gas movement upstream side (the left side) of the filter outer case 21 by a difference between these lengths (L7=L5−L6). In other words, in the case that the filter outer case 21 is connected to the catalyst outer case 5, the end portion on the exhaust gas movement upstream side (the left side) of the filter inner case 20 is inserted into the exhaust gas movement downstream side (the right side) of the catalyst outer case 5 only by the overlapping dimension L7.

On the basis of the structure mentioned above, the nitrogen dioxide (NO2) generated by the oxidation action of the diesel oxidation catalyst 2 is supplied to the soot filter 3 from a left end face 3*a* thereof. The collected particulate matter (PM) in the exhaust gas of the diesel engine 70 collected by the soot filter 3 is continuously oxidized and removed at a comparatively low temperature by the nitrogen dioxide (NO2). In addition to the removal of the particulate matter (PM) in the exhaust gas of the diesel engine 70, a carbon oxide (CO) and a hydro carbon (HC) in the exhaust gas of the diesel engine 70 are reduced.

As shown in FIGS. 1 to 5, in the exhaust gas purifying device provided with the diesel oxidation catalyst 2 and the soot filter 3 which serve as the gas purifying filter for purifying the exhaust gas discharged from the diesel engine 70, the catalyst inner case 4 and the filter inner case 20 which are internally provided with the diesel oxidation catalyst 2 and the soot filter 3, and the catalyst outer case 5 and the filter outer case 21 which are internally provided with the catalyst inner case 4 and the filter inner case 20, plural sets of diesel oxidation catalysts 2 and soot filters 3, the catalyst inner case 4 and the filter inner case 20, and the catalyst outer case 5 and the filter outer case 21 are provided, and the catalyst side flange 25 and the filter side flange 26 which serve as the flange body connecting the catalyst outer case 5 and the filter outer case 21 are provided such as to be offset with respect to the connection boundary position between the diesel oxidation catalyst 2 and the soot filter 3. Accordingly, it is possible to reduce the distance of the connection portion between the diesel oxidation catalyst 2 and the soot filter 3, and to shorten the connection length of the catalyst outer case 5 and the filter outer case 21. Further, the gas sensor or the like can be easily arranged at the connection boundary position of the diesel oxidation catalyst 2 and the soot filter 3. Since it is possible to shorten the length of the catalyst outer case 5 and the filter outer case 21 in the exhaust gas moving direction, it is possible to achieve an improvement of a rigidity and a weight saving of the catalyst outer case 5 and the filter outer case 21.

As shown in FIGS. 1 to 5, in the structure in which two kinds of diesel oxidation catalysts 2 and soot filters 3 are provided, since the catalyst outer case 5 internally provided with the catalyst inner case 4 of the other diesel oxidation catalyst 2 laps over the filter inner case 20 internally provided with the one soot filter 3. Thus it is possible to shorten the length of the catalyst outer case 5 and the filter outer case 21 in the exhaust gas moving direction while securing the length of the diesel oxidation catalyst 2 and the soot filter 3 in the exhaust gas moving direction. Further, since the catalyst inner case 4 (the other diesel oxidation catalyst 2) over which the catalyst outer case 5 laps is exposed largely to outside on the basis of a separation (a disassembly) of the catalyst outer case 5 and the filter outer case 21, an exposure range of the catalyst inner case 4 (the other diesel oxidation catalyst 2) is increased, and a maintenance work such as a soot removal in the one soot filter 3 or the like can be easily executed.

As shown in FIGS. 1 to 5, since the diesel oxidation catalysts 2 and the soot filters 3 are provided as the plural sets of gas purifying filters, and the catalyst side flange 25 and the filter side flange 26 are structured on the outer peripheral side of the soot filter 3 such as to be offset, the end portion of the inner case 20 on the exhaust gas inlet side of the soot filter 5 can be largely exposed from the end face of the outer case 21 on the basis of the separation of the catalyst outer case 5 and the filter outer case 21, and it is possible to easily execute a maintenance work such as the removal of the phosphor or the like attached to the soot filter 3 and the inner case 20.

As shown in FIGS. 1 to 5, in the structure in which two kinds of diesel oxidation catalysts 2 and soot filters 3 are provided, since the sensor mounting space 29 is formed between the catalyst inner case 4 provided internally with the one diesel oxidation catalyst 2, and the filter inner case 20 internally provided with the other soot filter 3. Thus it is possible to easily arrange the gas sensor or the like in the sensor mounting space 29 at the connection boundary position of the diesel oxidation catalyst 2 and the soot filter 3, while reducing the connection length, in the exhaust gas moving direction, of the catalyst outer case 5 and the filter outer case 21 and achieving an improvement of the rigidity and a weight saving of the catalyst outer case 5 and the filter outer case 21.

As shown in FIGS. 1 to 5, since the structure is made such that the sensor connection plug 50 serving as the sensor support body is assembled in the catalyst outer case 5 which is lapped over the filter inner case 20, and the gas sensor such as the filter inlet side exhaust gas pressure sensor, the filter inlet side exhaust gas temperature sensor (the thermistor), or the like which is not illustrated is arranged at the connection boundary position of the diesel oxidation catalyst 2 and the soot filter 3 via the sensor connection plug 50, it is possible to compactly install the sensor connection plug 50 at the connection boundary position of the diesel oxidation catalyst 2 and the soot filter 3, while intending to improve the rigidity and save weight of the catalyst outer case 5, the filter outer case 21, or the like.

As shown in FIGS. 1 to 5 and FIG. 8, in the exhaust gas purifying device provided with the diesel oxidation catalyst 2 or the soot filter 3 serving as the gas purifying filter for purifying the exhaust gas discharged from the diesel engine 70, the catalyst inner case 4 or the filter inner case 20 serving as the inner case which is internally provided with the diesel oxidation catalyst 2 or the soot filter 3, and the catalyst inner case 5 or the filter inner case 21 serving as the outer case which is internally provided with the catalyst inner case 4 or the filter inner case 20, the exhaust gas inflow port 12 is formed on the peripheral surface close to one end of the catalyst inner case 4 and the catalyst outer case 5, the exhaust gas inlet pipe 16 is arranged on the outer side of the exhaust gas inflow port 12 in the outer periphery of the catalyst outer case 5, and the area of the open end surface close to the exhaust gas outlet of the exhaust gas inlet pipe 16 is formed larger than the area of the open end surface close to the exhaust gas inlet of the exhaust gas inlet pipe 16. Accordingly, the exhaust gas inlet pipe can be arranged close to the installation portion of the diesel oxidation catalyst 2, and it is possible to easily shorten the length, in the exhaust gas moving direction, of the catalyst outer case 5 (the casing) on the exhaust gas upstream side of the diesel oxidation catalyst 2. In other words, it is possible to arrange the end face of the diesel oxidation catalyst 2 close to the end face on the upstream side in the exhaust gas moving direction of the catalyst outer case 5. Further, the exhaust gas inlet pipe 16 can be welded to the outer peripheral face of the catalyst outer case 5 by forming the area of the opening end face close to the exhaust gas outlet of the exhaust gas inlet pipe 16 larger than the area of the opening end face close to the exhaust gas inlet of the exhaust gas inlet pipe 16, and it is possible to reduce an exhaust pressure loss of the exhaust gas in the catalyst outer case 5 and the exhaust gas inlet pipe 16, while maintaining the mounting strength of the exhaust gas inlet pipe 16 on the exhaust gas inlet side of the catalyst outer case 5, without provision of the reinforcing member for connecting the catalyst outer case 5 and the exhaust gas inlet pipe 16 as in the conventional technique.

As shown in FIGS. 1, 2, 5 and 8, the structure is made such that an end edge close to the exhaust gas outlet of the exhaust gas inlet pipe 16 is firmly fixed to the outer peripheral surface of the exhaust gas inlet of the catalyst outer case 5, and the exhaust gas inlet pipe 16 is offset to the exhaust gas downstream side of the catalyst outer case 5, with respect to the exhaust gas inflow port 12 of the catalyst outer case 5. Accordingly, it is possible to arrange the exhaust gas upstream side end face of the diesel oxidation catalyst 2 on the upstream side of the exhaust gas rather than the opening edge on the exhaust gas downstream side of the exhaust gas inlet pipe 16, and to easily shorten the length of the catalyst outer case on the exhaust gas upstream side in the exhaust gas moving direction. It is possible to form the catalyst outer case 5 compactly in the exhaust gas moving direction. In other words, it is possible to arrange the exhaust gas outlet side of the exhaust gas inlet pipe 16 while being away from the side end face of the catalyst outer case 5 on the upstream side in the exhaust gas moving direction. It is possible to reduce the parts number in comparison with the conventional one by shortening the dimension of the catalyst outer case 5 in the exhaust gas moving direction, and to construct the device compactly and with a reduced weight at the low cost.

As shown in FIGS. 1, 2, 5 and 8, the opening dimension close to the exhaust gas outlet of the exhaust gas inlet pipe 16 is formed larger than the opening dimension of the exhaust gas inflow port 12 of the catalyst outer case 5 and the catalyst inner case 4, in the exhaust gas moving direction of the catalyst outer case 5. Accordingly, it is possible to maintain the mounting strength of the exhaust gas inlet pipe 16 on the exhaust gas inlet side of the catalyst outer case 5, and to reduce the exhaust gas pressure loss of the exhaust gas inlet pipe 16, the exhaust gas inflow port 12 of the catalyst outer case 5, and the like, without provision of the conventional reinforcing member. It is possible to reduce the number of the component parts so as to construct at the low cost, in comparison with the conventional structure provided with the reinforcing member. In spite that it is possible to compactly form an outer shape of the catalyst outer case 5, and to easily achieve a weight saving or the like, it is possible to construct the catalyst outer case 5 and the exhaust gas inlet side of the exhaust gas inlet pipe 16 and the like with a high rigidity. In other words, it is possible to form the exhaust gas inlet of the catalyst outer case 5 and the catalyst inner case 4, while making it close to the side end surface on the upstream side in the exhaust gas moving direction of the catalyst outer case 5. It is possible to shorten the dimension of the catalyst outer case 5 in the exhaust gas moving direction so as to reduce the parts number in comparison with the conventional one, whereby it is possible to construct the device compactly and with a reduced weight, at a low cost.

As shown in FIGS. 1, 2, 5 and 8, the exhaust gas purifying device is structured such that the end face on the exhaust gas movement upstream side of the diesel oxidation catalyst 2 or the soot filter 3 is arranged on the exhaust gas movement upstream side of the catalyst outer case 5 in comparison with the end portion on the exhaust gas movement downstream side in the exhaust gas outlet side of the exhaust gas inlet pipe 16. Accordingly, it is possible to easily shorten the length on the exhaust gas upstream side in the exhaust gas moving direction of the catalyst outer case 5, and to compactly form the length of the catalyst outer case 5 in the exhaust gas moving direction.

As shown in FIGS. 1, 2, 5 and 8, since the exhaust gas purifying device is structured such that the end portion close to the exhaust gas outlet side of the exhaust gas inlet pipe 16 is connected to the opening edge of the exhaust gas inflow port 12 on the exhaust gas movement upstream side, in the opening edge of the exhaust gas inflow port 12 of the catalyst outer case 5, it is possible to reduce the exhaust gas pressure loss in the catalyst outer case 5 and the exhaust gas inlet pipe 16, while it is also possible to easily shorten the length of the catalyst outer case 5 on the exhaust gas upstream side in the exhaust gas moving direction.

In the above case, the diesel oxidation catalyst 2 and the soot filter 3 are provided as the gas purifying filter for purifying the exhaust gas discharged from the engine, however, an NOx selective reduction catalyst (an NOx removal catalyst) and an ammonia removal catalyst may be provided in place of the diesel oxidation catalyst 2 and the soot filter 3, the NOx selectively reduction catalyst reducing a nitrogen oxide (NOx) in the exhaust gas of the engine 70 by an ammonia (NH3) generated by addition of urea (reducing agent), and the ammonia removal catalyst removing a residual ammonia discharged from the NOx selectively reduction catalyst.

As mentioned above, in the case that the NOx selectively reduction catalyst (the NOx removal catalyst) is provided in the catalyst inner case 4, and the ammonia removal catalyst is provided in the filter inner case 20, as the gas purifying filter, the nitrogen oxide (NOx) in the exhaust gas discharged from the engine is reduced, and can be discharged as a harmless nitrogen gas (N2).

As shown in FIGS. 1 to 5, in the exhaust gas purifying device provided with the diesel oxidation catalyst 2 and the soot filter 3 which serve as the gas purifying filter for purifying the exhaust gas discharged from the diesel engine 70, the catalyst inner case 4 and the filter inner case 20 which are internally provided with the diesel oxidation catalyst 2 and the soot filter 3, and the catalyst outer case 5 and the filter outer case 21 which are internally provided with the catalyst inner case 4 and the filter inner case 20, the catalyst inner case 4 and the filter inner case 20 are connected to the catalyst outer case 5 and the filter outer case 21, and the exhaust gas inlet pipe 16 serving as the inlet component part to which the external stress is applied, and the support leg body 19 serving as the support body are arranged in the catalyst outer case 5.

Accordingly, it is possible to support the external stress by the catalyst outer case 5, and to reduce the external stress acting as a deforming force on the catalyst inner case 4 and the filter inner case 20. In addition that it is possible to improve a processing capacity and a regeneration capacity of the diesel oxidation catalyst 2 and the soot filter 3, by improving a heat insulating property of the diesel oxidation catalyst 2 and the soot filter 3 on the basis of a double structure of the catalyst inner case 4 or the filter inner case 20 and the catalyst outer case 5 or the filter outer case 21, it is possible to easily prevent the support of the diesel oxidation catalyst 2 and the soot filter 3 from becoming inappropriate, for example, due to a transmission of the vibration from the engine, a strain of the welding process, or the like.

As shown in FIGS. 1 to 5, the plural sets of diesel oxidation catalysts 2 and soot filters 3, the catalyst inner cases 4 and the filter inner cases 20, and the catalyst outer cases 5 and the filter outer cases 21 are provided, and the plural sets of catalyst outer cases 5 and filter outer cases 21 are connected by the catalyst side flange 25 and the filter side flange 26 which serve as the flange body. Accordingly, taking into consideration of the structure of the exhaust gas inlet pipe 16 and the support leg body 18, the movement of the exhaust gas between the plural sets of diesel oxidation catalysts 2 and soot filters 3, and the like, it is possible to functionally construct the plural sets of catalyst inner cases 4 and filter inner cases 20, and the plural sets of catalyst outer cases 5 and filter outer cases 21. It is possible to easily improve the processing capacity and the regenerating capacity of the plural sets of diesel oxidation catalysts 2 and soot filters 3.

As shown in FIGS. 1 to 5, the length of the catalyst inner case 4 and the filter inner case 20 in the exhaust gas moving direction is differentiated from the length of the catalyst outer case 5 and the filter outer case 21 in the exhaust gas moving direction. Accordingly, it is possible to arrange the flange body connecting the catalyst outer case 5 and the filter outer case 21 so as to be offset with respect to the joint position of the plural sets of diesel oxidation catalyst 2 and the soot filter 3. It is possible to easily reduce or enlarge the mounting distance of the plural sets of diesel oxidation catalyst 2 and soot filers 3.

As shown in FIGS. 1 to 5, the plural sets of diesel oxidation catalysts 2 and soot filters 3, the catalyst inner cases 4 and the filter inner cases 20, and the catalyst outer cases 5 and the filter outer cases 21 are provided, the catalyst side flange 25 and the filter side flange 26 connecting the plural sets of catalyst outer cases 5 and filter outer cases 21 are structured such as to be offset with respect to the joint position of the plural sets of diesel oxidation catalysts 2 and soot filters 3, and the catalyst outer case 5 opposed to the diesel oxidation catalyst 2 on one side is structured such as to lap over the filter inner case 20 opposed to the soot filter 3 on the other side.

Accordingly, it is possible to easily arrange the sensor or the like in the joint between the plural sets of diesel oxidation catalysts 2 and soot filters 3, while it is possible to reduce the joint distance between the plural sets of diesel oxidation catalysts 2 and soot filters 3. It is possible to achieve an improvement of rigidity and a weight saving of the plural sets of catalyst outer cases 5 and filter outer cases 21, by shortening the length of the plural sets of catalyst outer cases 5 and filter outer cases 21 in the exhaust gas moving direction. It is possible to shorten the length of the plural sets of catalyst outer cases 5 and filter outer cases 21 in the exhaust gas moving direction, by reducing the joint distance between the plural sets of diesel oxidation catalysts 2 and soot filters 3.

As shown in FIGS. 1, 5, and FIGS. 8 to 14, the exhaust gas purifying device is provided with the diesel oxidation catalyst 2 or the soot filter 3 which serves as the gas purifying filter for purifying the exhaust gas discharged from the diesel engine 70, the catalyst inner case 4 or the filter inner case 20 which serves as the inner case internally provided with the diesel oxidation catalyst 2 or the soot filter 3, and the catalyst outer case 5 or the filter outer case 21 which serves as the outer case internally provided with the catalyst inner case 4 or the filter inner case 20. Further, the exhaust gas purifying device is structured such that the exhaust gas inlet pipe 16 is arranged on the outer side of the catalyst outer case 5, the exhaust gas inflow port 12 is open to the catalyst inner case 4 or the filter inner case 20 and the catalyst outer case 5 or the filter outer case 21 so as to be opposed to the exhaust gas outlet side of the exhaust gas inlet pipe 16, the exhaust gas inflow space 11 serving as the rectifying chamber is formed between the end face of the catalyst outer case 5 on the upstream side of the exhaust gas moving direction of the catalyst outer case 5 or the filter outer case 21 and the end face of the diesel oxidation catalyst 2 or the soot filter 3, and the exhaust gas inflow space 11 is communicated with the exhaust gas inlet pipe 16 via the exhaust gas inflow port 12. Therefore, for example, in the structure in which the exhaust gas of the diesel engine 70 is put into the catalyst inner case 4 from a shear direction which is orthogonal to the center line thereof, it is not necessary to insert the exhaust gas inlet pipe 16 into the exhaust gas inflow space 11. Accordingly, it is possible to reduce the number of the component parts for the structure of the catalyst outer case 5 provided with the exhaust gas inlet pipe 16, to construct the device at a low cost, and to easily shorten the length of the catalyst inner case 4 or the filter inner case 20, and the catalyst outer case 5 or the filter outer case 21 in the exhaust gas moving direction in the exhaust gas upstream side of the diesel oxidation catalyst 2 or the soot filter 3. In other words, it is possible to easily shorten a relative distance between the exhaust gas inlet side of the diesel oxidation catalyst 2, and the upstream side end face in the exhaust gas moving direction of the catalyst inner case 4 and the catalyst outer case 5 opposed thereto. The diesel oxidation catalyst 2 can be arranged so as to come close to the catalyst inner case 4 and the end face of the catalyst outer case 5 on the exhaust gas movement upstream side, it is possible to reduce the parts number in comparison with the conventional one by shortening the dimension of the catalyst inner case 4 or the filter inner case 20, and the catalyst outer case 5 or the filter outer case 21 in the exhaust gas moving direction, and it is possible to construct the device compactly with a reduced weight at a low cost.

As shown in FIGS. 1, 5, and FIGS. 8 to 14, since the opening dimension of the exhaust gas inflow port 12 in the direction which is orthogonal to the exhaust gas moving direction is formed larger than the opening dimension of the exhaust gas inflow port 12 of the catalyst outer case 5 in the exhaust gas moving direction of the catalyst outer case 5 or the filter outer case 21, it is possible to reduce the parts number in comparison with the conventional one, by shortening the dimension of the catalyst inner case 4 or the filter inner case 20 and the catalyst outer case 5 or the filter outer case 21 in the exhaust gas moving direction while maintaining the mounting rigidity of the exhaust gas inlet pipe 16 to the catalyst outer case 5. Thus it is possible to construct compactly and with a reduced weight at a low cost.

As shown in FIGS. 1, 5, and FIGS. 8 to 14, since the opening dimension of the exhaust gas inflow port 12 is formed smaller than the opening dimension of the exhaust gas outlet of the exhaust gas inlet pipe 16, in the exhaust gas moving direction of the catalyst outer case 5 or the filter outer case 21, it is possible to uniformly supply the exhaust gas to the exhaust gas inlet side of the diesel oxidation catalyst 2 from the exhaust gas inflow space 11, and to construct the catalyst inner case 4 or the filter inner case 20 and the catalyst outer case 5 or the filter outer case 21 compactly and with a reduced weight, while maintaining the gas purifying function of the diesel oxidation catalyst 2.

As shown in FIGS. 1 and 5, and FIGS. 8 to 14, since the opening shape of the exhaust gas inflow port 12 is formed as any one of an oval shape, a rectangular shape, an oblong hole shape, and similar shapes thereof, and the opening diameter close to the exhaust gas inlet of the exhaust gas inlet pipe 16 is formed so as to be approximately equal to the opening dimension of the exhaust gas inflow port 12 of the catalyst outer case 5 in the exhaust gas moving direction along the catalyst outer case 5 or the filter outer case 21, it is possible to form the opening area of the exhaust gas inflow port 12 larger than the opening area close to the exhaust gas inlet of the exhaust gas inlet pipe 16. The exhaust gas can be moved into the exhaust gas inflow space 11 from the exhaust gas inflow port 12 while dispersing the exhaust gas in a direction which is orthogonal to the exhaust gas moving direction of the diesel oxidation catalyst 2, and it is possible to reduce a drift of the exhaust gas with respect to the diesel oxidation catalyst 2.

As shown in FIGS. 1, 5, and FIGS. 8 to 14, the exhaust gas purifying device is structured such that the opening diameter close to the exhaust gas inlet of the exhaust gas inlet pipe 16 is formed so as to be approximately equal to the opening dimension of the exhaust gas inflow port 12 of the catalyst outer case 5 in the exhaust gas moving direction of the catalyst outer case 5 or the filter outer case 21, the opening diameter close to the exhaust gas outlet of the exhaust gas inlet pipe 16 is formed so as to be approximately equal to the opening dimension of the exhaust gas inflow port 12 in the direction which is orthogonal to the exhaust gas moving direction, and the end portion close to the exhaust gas outlet of the exhaust gas inlet pipe 16 is connected to the opening edge of the exhaust gas inflow port 12 in the exhaust gas movement upstream side, in the opening edge of the exhaust gas inflow port 12. Accordingly, it is possible to disperse the exhaust gas in the direction which is orthogonal to the exhaust gas moving direction of the diesel oxidation catalyst 2, and to uniformly move the exhaust gas from the exhaust gas inflow port 12 to the exhaust gas inlet side of the diesel oxidation catalyst 2. It is possible to reduce the drift of the exhaust gas with respect to the diesel oxidation catalyst 2, and to improve the exhaust gas purifying capacity of the diesel oxidation catalyst 2.

A mounting structure of a silencer 30 will be described with reference to FIGS. 1 to 3 and FIGS. 5 to 7. As shown in FIGS. 1 to 3 and FIG. 5, the silencer 30 for damping an exhaust gas noise discharged from the diesel engine 70 has an approximately cylindrical noise reduction inner case 31 made of a heat resisting metal material, an approximately cylindrical noise reduction outer case 32 made of a heat resisting metal material, and a disc shaped right lid body 33 firmly fixed to a right end portion of the noise reduction inner case 31 and the noise reduction outer case 32 by welding. The noise reduction outer case 32 is internally provided with the noise reduction inner case 31. Further, the cylindrical noise reduction outer case 32 has approximately the same dimension as the diameter of the cylindrical catalyst outer case 5, and the diameter of the cylindrical filter outer case 21. The cylindrical noise reduction inner case 31 has approximately the same dimension as the diameter of the cylindrical catalyst inner case 4, and the diameter of the cylindrical filter inner case 20. In this case, the cylindrical noise reduction inner case 31 may not have the same dimension as the diameter of the cylindrical catalyst inner case 4 and the diameter of the cylindrical filter inner case 20.

As shown in FIGS. 4 to 7, an exhaust gas outlet pipe 34 is penetrated the noise reduction inner case 31 and the noise reduction outer case 32. One end side of the exhaust gas outlet pipe 34 is closed by an outlet lid body 35. A lot of exhaust holes 36 are perforated in a whole of the exhaust gas outlet pipe 34 inside the noise reduction inner case 31. An inner portion of the noise reduction inner case 31 is communicated with the exhaust gas outlet pipe 34 via a lot of exhaust holes 36. A silencer or a tail pipe which is not illustrated is connected to the other end side of the exhaust gas outlet pipe 34.

As shown in FIGS. 6 and 7, a lot of noise reduction holes 37 are perforated in the noise reduction inner case 31. An inner portion of the noise reduction inner case 31 is communicated with a portion between the noise reduction inner case 31 and the noise reduction outer case 32 via a lot of noise reduction holes 37. A space between the noise reduction inner case 31 and the noise reduction outer case 32 is closed by the right lid body 33 and a support body 38 made of a thin plate. A noise reduction material 39 made of a ceramic fiber is filled between the noise reduction inner case 31 and the noise reduction outer case 32. An end portion on an exhaust gas movement upstream side (a left side) of the noise reduction case 31 is connected to an end portion on an exhaust gas movement upstream side (a left side) of the noise reduction outer case 32 via the thin plate support body 38.

On the basis of the structure mentioned above, the exhaust gas is discharged from the inside of the noise reduction inner case 31 via the exhaust gas outlet pipe 34. Further, in the inner portion of the noise reduction inner case 31, an exhaust gas noise (mainly constructed by a noise in a high frequency band) is absorbed by the noise reduction material 39 through a lot of noise reduction holes 37. An undesired sound of the exhaust gas discharged from the outlet side of the exhaust gas outlet pipe 34 is damped.

As shown in FIGS. 1 and 5, a filter side outlet flange 40 is welded to an end portion on an exhaust gas movement downstream side (a right side) of the filter inner case 20 and the filter outer case 21. A noise reduction side flange 41 is welded to an end portion on an exhaust gas movement upstream side (a left side) of the noise reduction outer case 32. The filter side outlet flange 40 and the noise reduction side flange 41 are detachably fastened by a bolt 42 and a nut 43. In this structure, a sensor connection plug 44 is firmly fixed to the filter inner case 20 and the filter outer case 21. An outlet side exhaust gas pressure sensor, an outlet side exhaust gas temperature sensor (a thermistor), and the like which are not illustrated are connected to the sensor connection plug 44, As shown in FIGS. 1 and 2, and FIGS. 5 to 7, in the exhaust gas purifying device provided with the diesel oxidation catalyst 2 or the soot filter 3 which serves as the gas purification filter for purifying the exhaust gas discharged from the diesel engine 70, the catalyst inner case 4 or the filter inner case 20 which serves as the inner case internally provided with the diesel oxidation catalyst 2 or the soot filter 3, and the catalyst outer case 5 or the filter outer case 21 which serves as the outer case internally provided with the catalyst inner case 4 or the filter inner case 20, since the noise reduction material 39 serving as the exhaust gas damping body for damping the exhaust noise of the exhaust gas discharged from the diesel engine 70 is provided, and the noise reduction material 39 is arranged in the end portion close to the exhaust gas outlet of the catalyst outer case 5 or the filter outer case 21, it is possible to easily add a noise reduction function of the exhaust gas without changing the structure of the diesel oxidation catalyst 2 or the soot filter 3, while maintaining the exhaust gas purification function of the diesel oxidation catalyst 2 or the soot filter 3. For example, it is possible to easily construct an exhausting structure in which the tail pipe is directly connected to the outer case, an exhausting structure which further improves a noise reduction function of the existing silencer, and the like. Further, it is possible to easily execute a high frequency reduction countermeasure of the exhaust gas which is hard to be executed by the diesel oxidation catalyst 2 or the soot filter 3. For example, it is possible to easily install a noise reduction structure (the noise reduction material 39) formed by a punch hole and a fiber mat.

As shown in FIGS. 5 to 7, since the exhaust gas purifying device is structured such that the silencer 30 having the noise reduction material 39 is provided, and the silencer 30 is detachably connected to the exhaust gas outlet side end portion of the filter outer case 21, it is possible to easily change the exhaust gas noise reduction function in the diesel oxidation catalyst 2 or the soot filter 3.

As shown in FIGS. 5 to 7, the exhaust gas purifying device is structured such that the silencer 30 having the noise reduction material 39 is provided, the catalyst outer case 5 or the filter outer case 21 and the silencer 30 each are formed as the cylindrical shape having approximately the same outer diameter, the filter side outlet flange 40 serving as the ring shaped flange body is provided in the end portion close to the exhaust gas outlet of the filter outer case 21, and the noise reduction material 39 is detachably connected to the end portion close to the exhaust gas outlet of the filter outer case 21 via the filter side outlet flange 40. Thus the silencer 30 can be incorporated compactly only by elongating the mounting dimension of the catalyst outer case 5 or the filter outer case 21 in the exhaust gas moving direction, on the basis of the silencer 30 having approximately the same outer diameter being connected to the filter outer case 21 by the filter side outlet flange 40. For example, the catalyst outer case 5 or the filter outer case 21 can be easily installed close to the side surface of the exhaust gas discharge portion of the diesel engine 70. Further, it is possible to easily execute the high frequency reduction countermeasure of the exhaust gas by installing the noise reduction material 39, while improving the gas purifying function of the diesel oxidation catalyst 2 or the soot filter 3, on the basis of temperature maintenance of the exhaust gas.

As shown in FIGS. 5 to 7, since the exhaust gas purifying device is structured such that the noise reduction inner case 31 and the noise reduction outer case 32, and the exhaust gas outlet pipe 34 are provided, the noise reduction inner case 31 and the noise reduction outer case 32 serving as the silencer casing in which the noise reduction material 39 is installed, and the exhaust gas outlet pipe 34 having the closed one end and the other end side communicated with the tail pipe (not shown), the exhaust hole 36 forming portion of the exhaust gas outlet pipe 34 is penetrated the noise reduction inner case 31 and the noise reduction outer case 32, and the noise reduction inner case 31 and the noise reduction outer case 32 are detachably connected to the exhaust gas outlet side end portion of the filter outer case 21 via the filter side outlet flange 40, it is possible to easily change the exhaust gas noise reduction function in the diesel oxidation catalyst 2 or the soot filter 3 portion, by attaching and detaching the noise reduction inner case 31 and the noise reduction outer case 32. For example, it is possible to easily construct an exhausting structure or the like further improving the noise reduction function of the exhaust gas, by installing a silencer (not shown) in addition to the noise reduction inner case 31 and the noise reduction outer case 32. On the other hand, it is possible to easily construct an exhaust structure in which the tail pipe (not shown) is connected directly to the filter outer case 21, by arranging the noise reduction inner case 31 and the noise reduction outer case 32 in which the noise reduction material 39 is not installed. Further, it is possible to easily construct a noise reduction structure of the noise reduction material 39 (the punch hole, the fiber mat, and the like) within the noise reduction inner case 31 and the noise reduction outer case 32, as the high frequency reduction countermeasure of the exhaust gas which is hard to be executed in the diesel oxidation catalyst 2 or the soot filter 3 portion.

As shown in FIGS. 5 to 7, since the silencer casing has the cylindrical noise reduction inner case 31 and the cylindrical noise reduction outer case 32, and is structured such that the sound reduction inner case 31 is arranged within the sound reduction outer case 32, the sound reduction material 39 is filled between the sound reduction inner case 31 and the sound reduction outer case 32, and a lot of sound reduction holes 37 are formed in the sound reduction inner case 31, the silencer casing (the sound reduction inner case 31 and the sound reduction outer case 32) can be constructed so as to be similar to the exhaust gas purifying structure provided with the catalyst inner case 4 or the filter inner case 20 which is internally provided with the diesel oxidation catalyst 2 or the soot filter 3, and the catalyst outer case 5 or the filter outer case 21. The sound reduction inner case 31 and the sound reduction outer case 32 of the silencer casing may be formed by utilizing the same material (the pipe or the like) as that of the catalyst inner case 4 or the filter inner case 20 internally provided with the diesel oxidation catalyst 2 or the soot filter 3, and the catalyst outer case 5 or the filter outer case 21. It is possible to easily reduce a manufacturing cost of the silencer casing.

Figure 10:
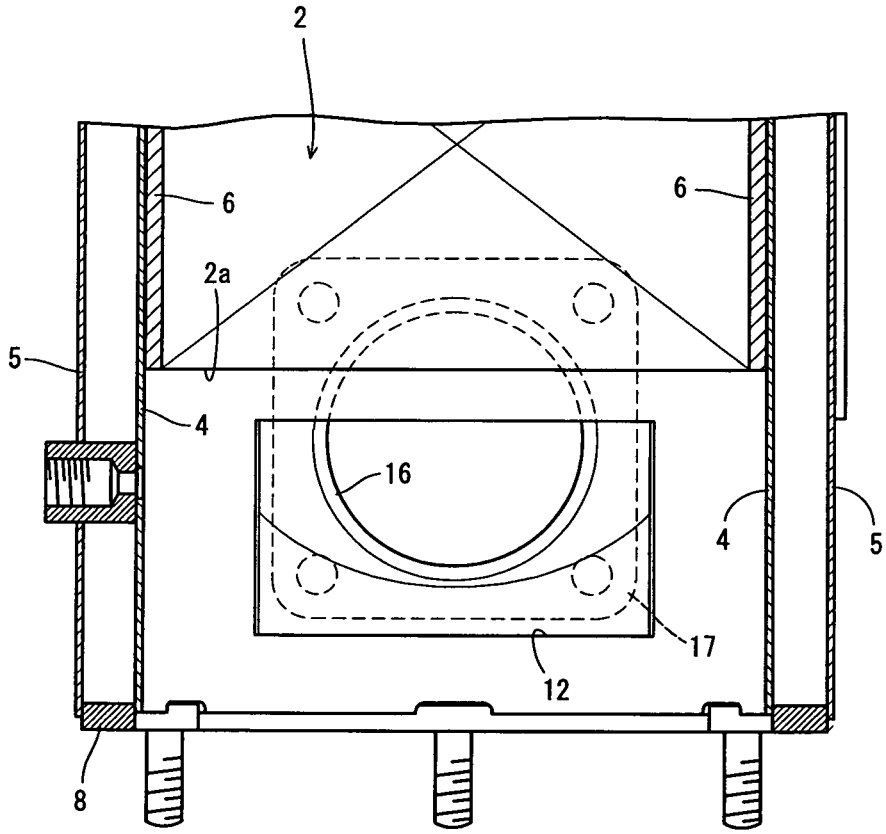
FIG. 10 is an enlarged cross sectional view in a plan view of the exhaust gas inflow side and shows a modified embodiment of FIG. 9.
Figure 11:
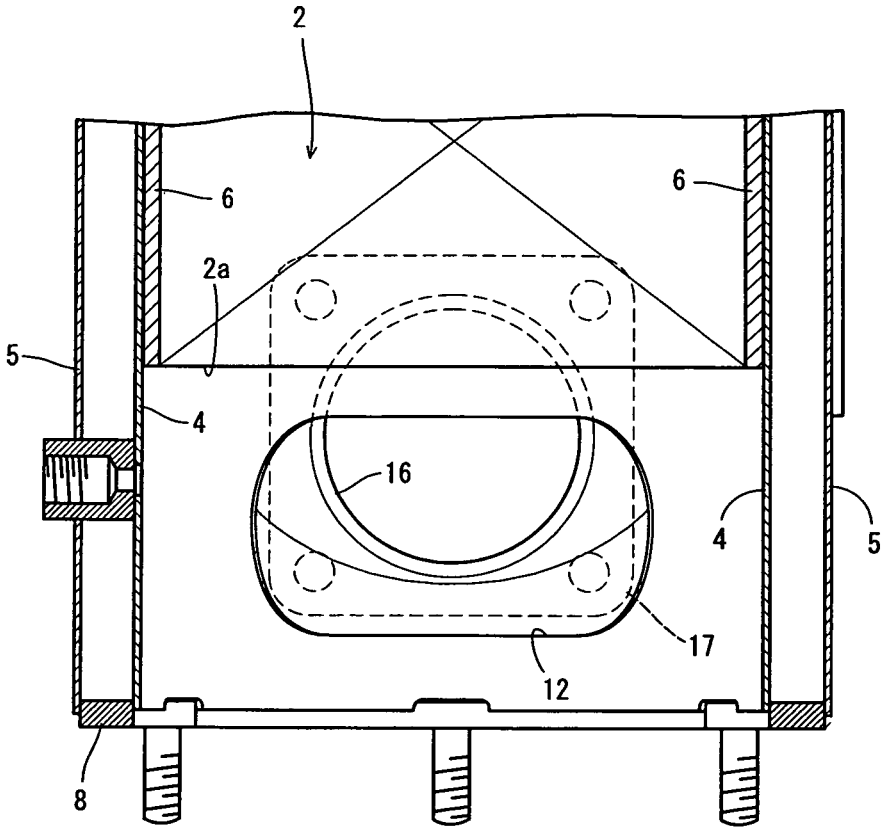
FIG. 11 is an enlarged cross sectional view in a plan view of the exhaust gas inflow side and shows a modified embodiment of FIG. 9.
Figure 12:
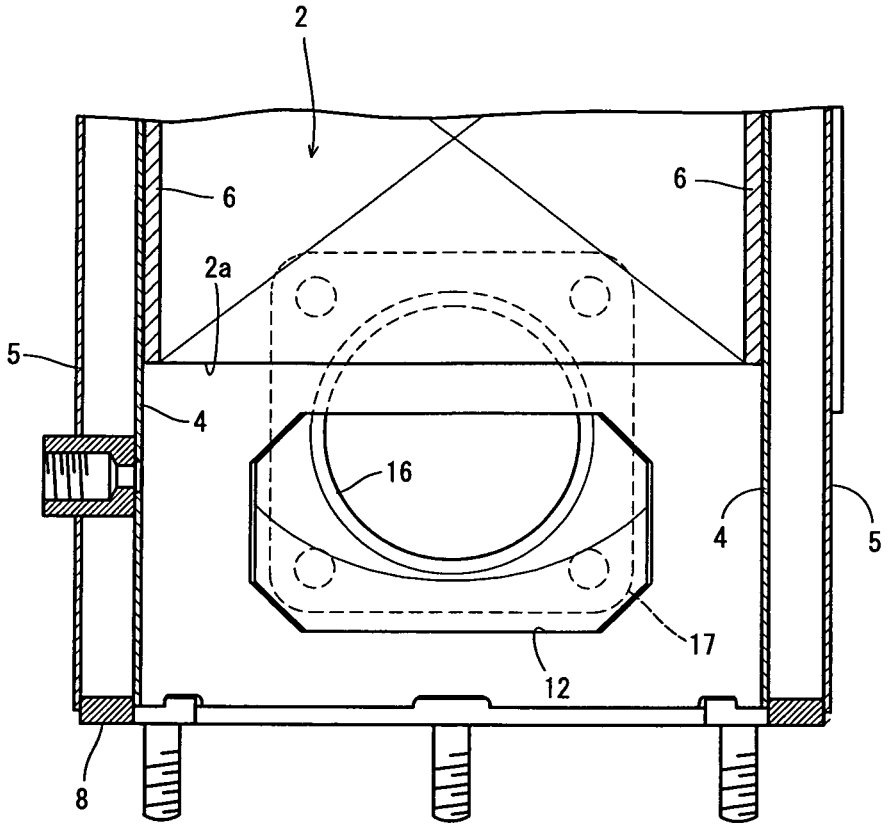
FIG. 12 is an enlarged cross sectional view in a plan view of the exhaust gas inflow side and shows a modified embodiment of FIG. 9.
Figure 13:
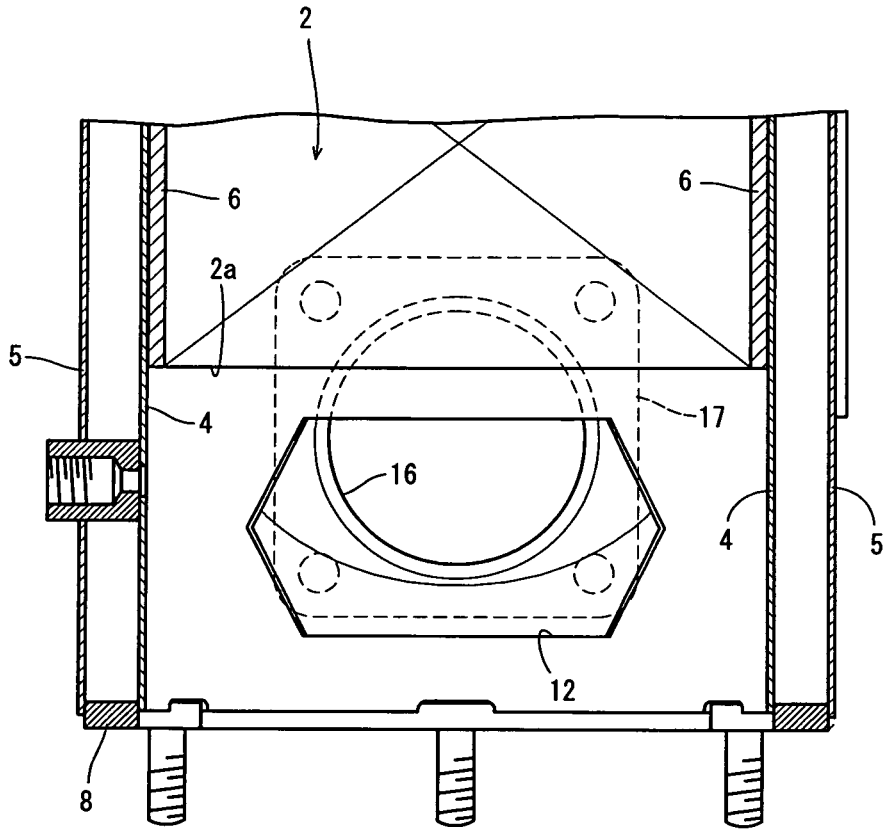
FIG. 13 is an enlarged cross sectional view in a plan view of the exhaust gas inflow side and shows a modified embodiment of FIG. 9.
Figure 14:
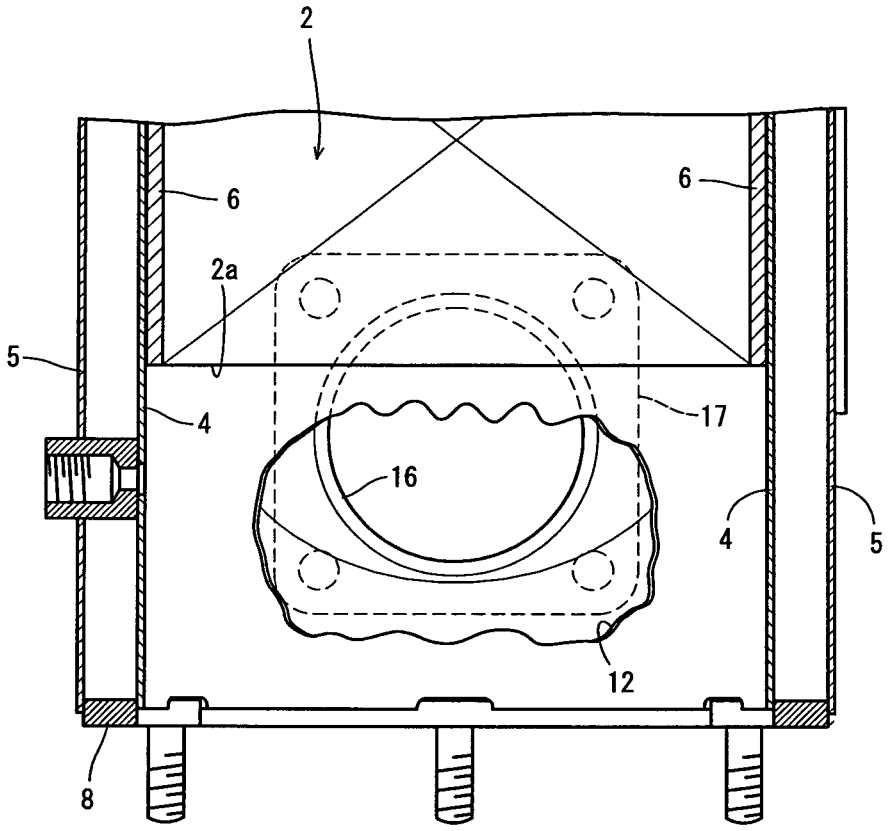
FIG. 14 is an enlarged cross sectional view in a plan view of the exhaust gas inflow side and shows a modified embodiment of FIG. 9.

A modified structure of the exhaust gas inflow port 12 will be described with reference to FIGS. 10 to 14. In the embodiment mentioned above, the exhaust gas inflow port 12 is formed by perforating the through hole having approximately the oval shape in the catalyst inner case 4 and the catalyst outer case 5, as shown in FIG. 9. As shown in FIG. 10, the exhaust gas inflow port 12 may be formed by perforating a through hole having approximately a rectangular hole in the catalyst inner case 4 and the catalyst outer case 5. Further, as shown in FIG. 11, the exhaust gas inflow port 12 may be formed by perforating a through hole having approximately an elliptic shape in the catalyst inner case 4 and the catalyst outer case 5. Further, as shown in FIG. 12, the exhaust gas inflow port 12 may be formed by perforating a through hole having approximately a polygonal shape in the catalyst inner case 4 and the catalyst outer case 5. Further, as shown in FIG. 13, the exhaust gas inflow port 12 may be formed by perforating a through hole having approximately a hexagonal shape in the catalyst inner case 4 and the catalyst outer case 5. Further, as shown in FIG. 14, the exhaust gas inflow port 12 may be formed by perforating a through hole having an undefined form in the catalyst inner case 4 and the catalyst outer case 5.

Figure 23:
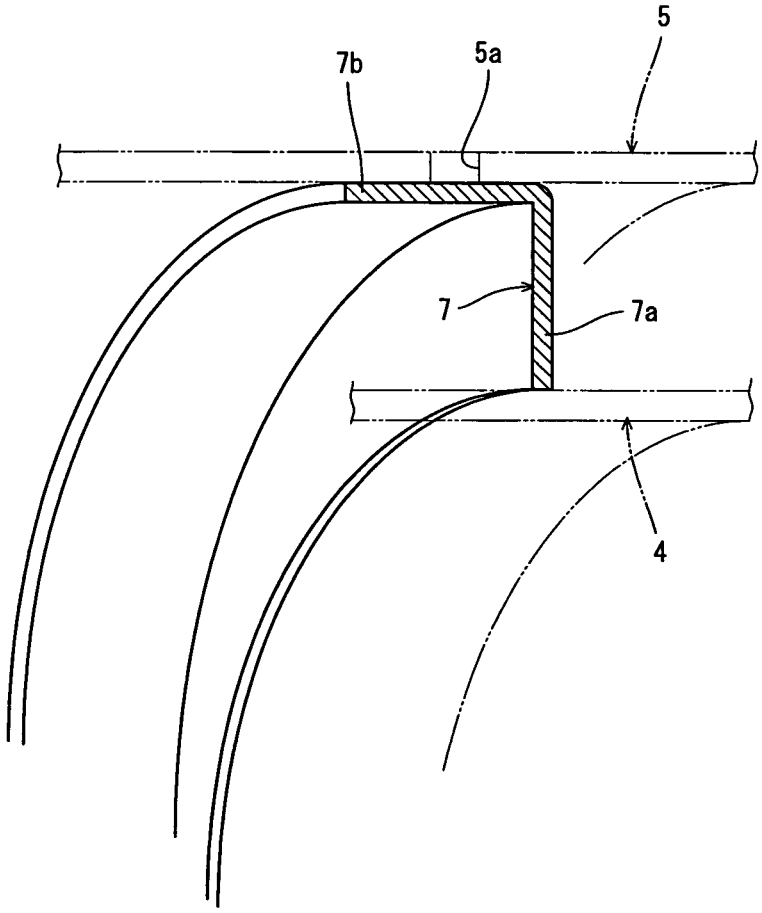
FIG. 23 is an enlarged cross sectional view of an inner case support body.
Figure 24:
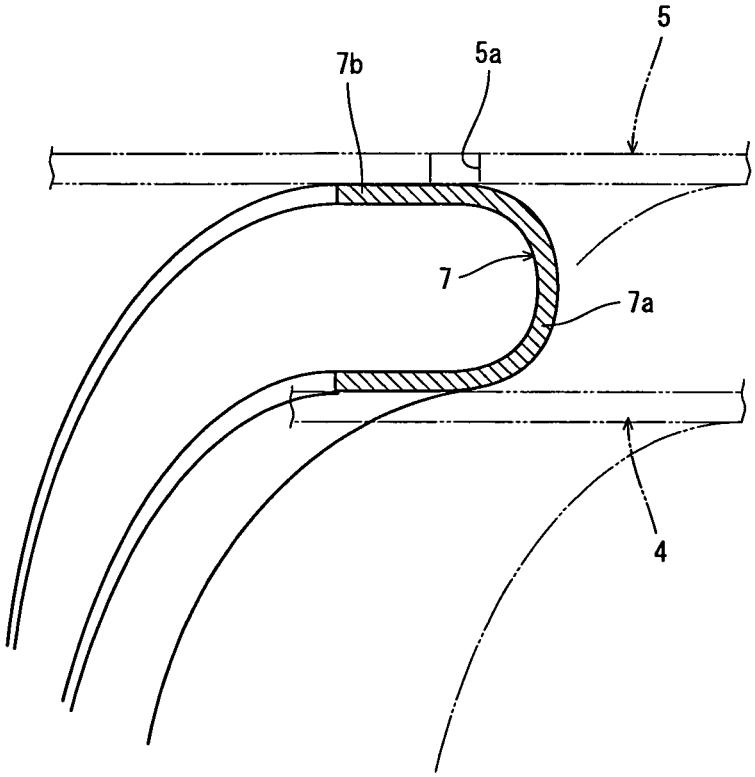
FIG. 24 is an enlarged cross sectional view of the inner case support body and shows a modified embodiment of FIG. 23.

The structure of the inner case support body 7 will be described with reference to FIGS. 1 and 5 and FIGS. 23 to 27. As shown in FIGS. 1, 5 and 23, the exhaust gas purifying device is structured such that the cylindrical catalyst outer case 5 is fitted to the outer side of the cylindrical catalyst inner case 4 via a ring shaped inner case support body 7 having an I-shaped end face and made of a thin plate, and a stress (a deforming force) of the catalyst outer case 5 is reduced by the thin plate inner case support body 7. As shown in FIG. 23, the inner case support body 7 has an I-shaped thin plate portion 7*a*, and an outer case connection portion 7*b*. An inner diameter side end edge of the I-shaped thin plate portion 7*a* is welded to an outer surface on the exhaust gas movement downstream side of the catalyst inner case 4. In other words, the I-shaped thin plate portion 7*a* is raised approximately vertical to the outer surface of the catalyst inner case 4, and is protruded in a radial direction from the outer surface of the catalyst inner case 4. The outer case connection portion 7*b* is extended in a direction of being bent approximately at a right angle from an outer diameter side end edge of the I-shaped thin plate portion 7*a*. A cross sectional end face of the inner case support body 7 is formed as an L-shaped form by the I-shaped thin plate portion 7*a* and the outer case connection portion 7*b*.

Further, the end portion of the outer case connection portion 7*b* is extended in the exhaust gas moving direction (the direction of the center line of the cylindrical case 5) along the inner surface of the catalyst outer case 5. The outer case connection portion 7*b* is welded to an inner surface of an intermediate portion of the catalyst outer case 5 in the exhaust gas moving direction via a welding process hole 5*a* open to the catalyst outer case 5. In this structure, the welding process hole 5*a* is closed by the welding process of the outer case connection portion 7*b*. In other words, as shown in FIGS. 1 and 23, in the exhaust gas purifying device provided with the diesel oxidation catalyst 2 or the soot filter 3 which serves as the gas purifying filter for purifying the exhaust gas discharged from the diesel engine 70, the catalyst inner case 4 or the filter inner case 20 which serves as the inner case internally provided with the diesel oxidation catalyst 2 or the soot filter 3, and the catalyst outer case 5 or the filter outer case 21 which serves as the outer case internally provided with the catalyst inner case 4 or the filter inner case 20, the ring shaped inner case support body 7 is provided between the catalyst inner case 4 and the catalyst outer case 5, the inner case support body 7 is formed by the flexible material having the vibration damping function, and the catalyst inner case 4 is supported to the catalyst outer case 5 via the inner case support body 7.

As a result, the vibration of the catalyst outer case 5 is damped by the inner case support body 7, reducing the vibration transmitted from the catalyst outer case 5 to the catalyst inner case 4, and therefore it is possible to easily prevent the reduction of a sealing performance of the diesel oxidation catalyst 2, and prevent damage and falling off of the catalyst outer case 5, the catalyst inner case 4, or the diesel oxidation catalyst 2. In other words, it is possible to reduce the reduction of the sealing performance of the catalyst outer case 5 or the catalyst inner case 4, and to improve a durability of the diesel oxidation catalyst 2. Further, it is possible to easily improve a maintenance workability of the soot filter 3 even in the filter structure in which the purifying capacity of the exhaust gas is enhanced, for example, by combining a plurality of diesel oxidation catalysts 2 or soot filters 3. Further, it is possible to control a temperature of the catalyst inner case 4 (the diesel oxidation catalyst 2) on the basis of a heat insulating action of the space between the catalyst inner case 4 and the catalyst outer case 5. It is possible to maintain the temperature of the diesel oxidation catalyst 2 at an appropriate temperature for a catalyst (from about 300 degree to about 500 degree).

As shown in FIGS. 1, 5 and 23, the inner case support body 7 is formed by the thin plate having the I-shaped cross sectional end face, and is structured such that one end side of the inner case support body 7 is extended in a direction extending along the inner surface of the catalyst outer case 5, the outer case connection portion 7*b* welded to the catalyst outer case 5 is formed in the extension portion in the one end side of the inner case support body 7, and the outer case connection portion 7*b* is firmly fixed to the inner surface of the catalyst outer case 5. Thus it is possible to weld the outer case connection portion 7*b* to the catalyst outer case 5 from the outer side of the catalyst outer case 5 by inserting the catalyst inner case 4 into the catalyst outer case 5 in a state in which the other end side of the inner case support body 7 is welded to the outer face of the catalyst inner case 4. The inner case support body 7 can be formed by the thin plate having a thickness which is not limited by the welding work. It is possible to improve an assembling workability of the catalyst outer case 5 and the catalyst inner case 4.

As shown in FIGS. 1, 5 and 23, the exhaust gas purifying device is provided with a plurality of diesel oxidation catalyst 2 or soot filters 3, the catalyst inner case 4 or the filter inner case 20, and the catalyst outer case 5 or the filter outer case 21, and is structured such that the catalyst side flange 25 or the filter side flange 26 which serves as the flange body connecting the catalyst outer case 5 or the filter outer case 21 is offset with respect to the connection position of a plurality of diesel oxidation catalysts 2 or soot filters 3, and is structured such that the catalyst outer case 5 which is opposed to the other diesel oxidation catalyst 2 laps over the filter inner case 20 which is opposed to one soot filter 3. Thus it is possible to shorten the length of a plurality of catalyst outer cases 5 or filter outer cases 21 in the exhaust gas moving direction while securing an installation length of a plurality of diesel oxidation catalysts 2 or soot filters 3 in the exhaust gas moving direction, achieving an improvement of a rigidity of a plurality of catalyst outer cases 5 or filter outer cases 21 and a weight saving thereof. Further, the filter inner case 20 over which the catalyst outer case 5 laps (the soot filter 3 on the exhaust gas movement downstream side) can be largely exposed to the outside on the basis of a separation (a disassemble) of the catalyst outer case 5 or the filter outer case 21. In other words, an exposure range on the exhaust gas movement upstream side end portion of the soot filter arranged in the gas movement downstream side (the filter inner case 20 on the exhaust gas movement downstream side) among a plurality of diesel oxidation catalysts 2 or soot filters 3 is increased, thereby making it possible to easily execute a maintenance work such as a removal of the soot of the soot filter 3 on the exhaust gas movement downstream side or the like. It is possible to improve a maintenance work such as a cleaning of the soot filter 3 which is executed by separating the catalyst outer case 5 or the filter outer case 21 (the catalyst inner case 4 or the filter inner case 20) in the connection portion of the catalyst side flange 25 or the filter side flange 26.

Figure 25:
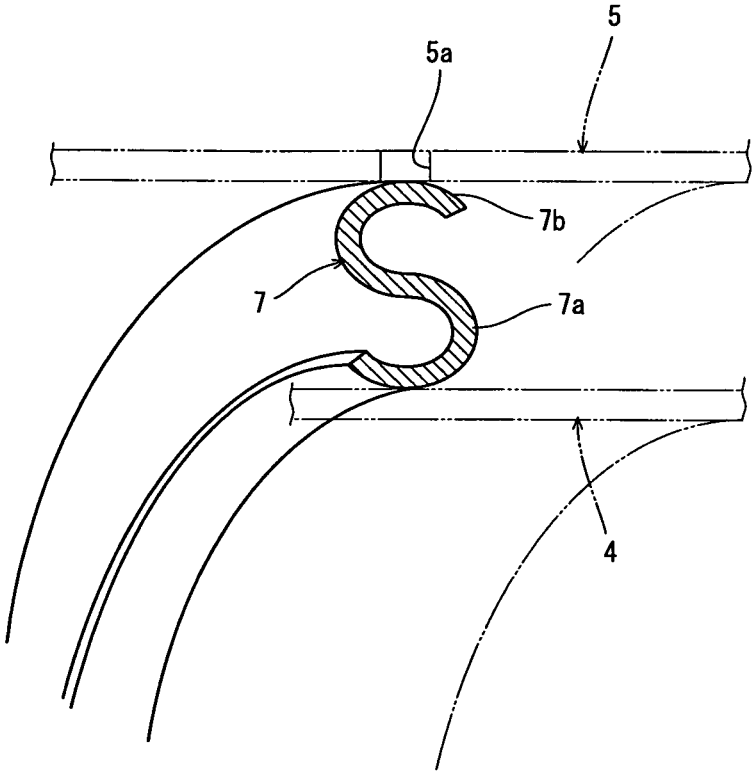
FIG. 25 is an enlarged cross sectional view of the inner case support body and shows a modified embodiment of FIG. 23.
Figure 26:
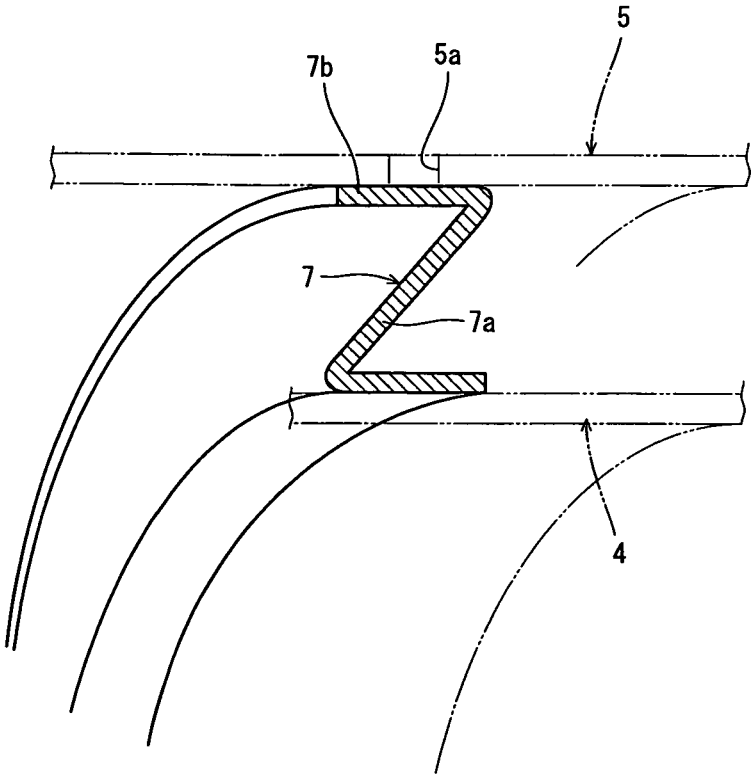
FIG. 26 is an enlarged cross sectional view of the inner case support body and shows a modified embodiment of FIG. 23.
Figure 27:
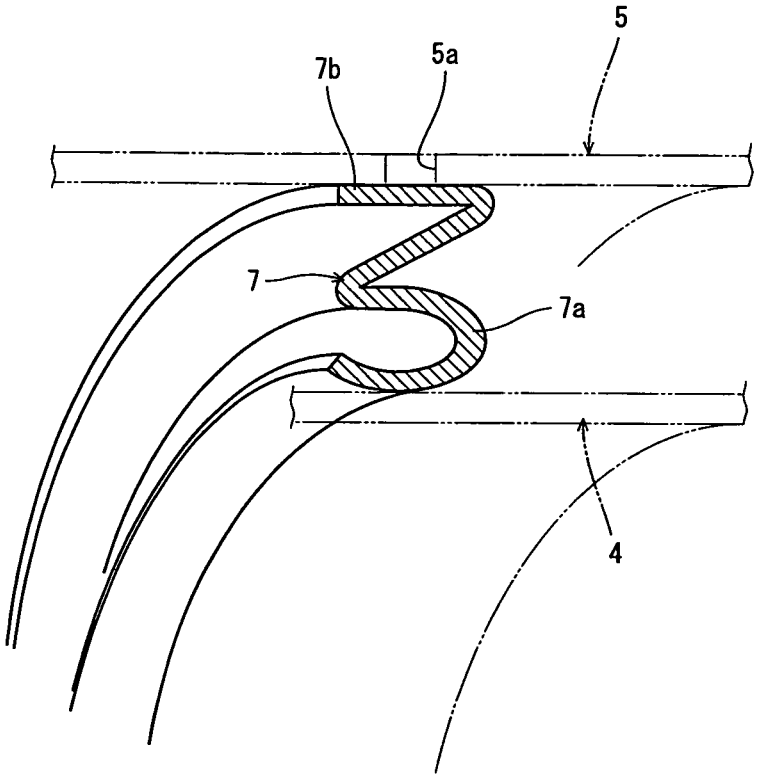
FIG. 27 is an enlarged cross sectional view of the inner case support body and shows a modified embodiment of FIG. 23.

FIGS. 24 to 27 show a modified structure of the inner case support body 7 which is disclosed in FIG. 23. In the embodiment mentioned above, the inner case support body 7 is formed by the ring shaped thin plate having the I-shaped end face, however, the inner case support body 7 may be formed by a ring shaped thin plate having a U-shaped end face. Further, as shown in FIG. 25, the inner case support body 7 may be formed by a ring shaped thin plate having an S-shaped end face. As shown in FIG. 26, the inner case support body 7 may be formed by a ring shaped thin plate having a Z-shaped end face. As shown in FIG. 27, the inner case support body 7 may be formed by a ring shaped thin plate having a compound end face obtained by combining the Z-shaped form and the S-shaped form.

As shown in FIGS. 23 to 26, since the inner case support body 7 is formed by any one of the thin plate having the I-shaped cross sectional end face (refer to FIG. 23), the thin plate having the U-shaped cross sectional end face (refer to FIG. 24), the thin plate having the S-shaped cross sectional end face (refer to FIG. 25), and the thin plate having the Z-shaped cross sectional end face (refer to FIG. 26), and is structured such that the catalyst inner case 4 is elastically supported to the catalyst outer case 5 via the inner case support body 7, it is possible to support the outer face side of the exhaust gas movement downstream side end portion of the catalyst inner case 4 with a high rigidity, even in the filter structure in which the purifying capacity of the exhaust gas is enhanced, for example, by setting the plural sets of catalyst outer cases 5 or filter outer cases 21 and the catalyst inner cases 4 or the filter inner cases 20, and combining a plurality of diesel oxidation catalysts 2 or soot filters 3. It is possible to easily improve a maintenance workability of the exhaust gas movement upstream side end portion of the soot filter 3 which is arranged on the exhaust gas movement downstream side. Further, it is possible to easily prevent the reduction of the sealing performance of the diesel oxidation catalyst 2 or the soot filter 3, and damage or falling off of the catalyst outer case 5 or the filter outer case 21 or the catalyst inner case 4 or the filter inner case 20 or the diesel oxidation catalyst 2 or the soot filter 3.

As shown in FIG. 27, since the inner case support body is formed by the thin plate having the combined shape obtained by two or more of the I-shaped cross sectional end face (refer to FIG. 23), the thin plate having the U-shaped cross sectional end face (refer to FIG. 24), the thin plate having the S-shaped cross sectional end face (refer to FIG. 25), and the thin plate having the Z-shaped cross sectional end face (refer to FIG. 26), and is structured such that the catalyst inner case 4 is elastically supported to the catalyst outer case 5 via the inner case support body 7, it is possible to support the outer face side of the exhaust gas movement downstream side end portion of the catalyst inner case 4 with a high rigidity to the inner face side in the middle of the catalyst outer case 5 in the exhaust gas moving direction via the inner case support body 7, even in the filter structure in which the purifying capacity of the exhaust gas is enhanced by setting the plural sets of catalyst outer cases 5 or filter outer cases 21 and the catalyst inner cases 4 or the filter inner cases 20, and combining a plurality of diesel oxidation catalysts 2 or soot filters 3. It is possible to easily improve a maintenance workability of the exhaust gas movement upstream side end portion of the soot filter 3 which is arranged on the exhaust gas movement downstream side. Further, it is possible to easily prevent the reduction of the sealing performance of the diesel oxidation catalyst 2 or the soot filter 3, and damages or falling off of the catalyst outer case 5 or the filter outer case 21, the catalyst inner case 4 or the filter inner case 20, or the diesel oxidation catalyst 2 or the soot filter 3.

A structure in which the DPF 1 is provided in the diesel engine 70 will be described with reference to FIGS. 15 to 18. As shown in FIGS. 15 to 18, the exhaust manifold 71 and an intake manifold 73 are arranged in left and right surfaces of the cylinder head 72 of the diesel engine 70. The cylinder head 72 is mounted on a cylinder block 75 having an engine output shaft 74 (a crank shaft) and a piston (not shown). A front end and a rear end of the engine output shaft 74 are protruded from a front face and a rear face of the cylinder block 75. A cooling fan 76 is provided on a front face of the cylinder block 75. The structure is made such that a turning force is transmitted from a front end side of the engine output shaft 74 to the cooling fan 76 via a V belt 77.

Figure 15:
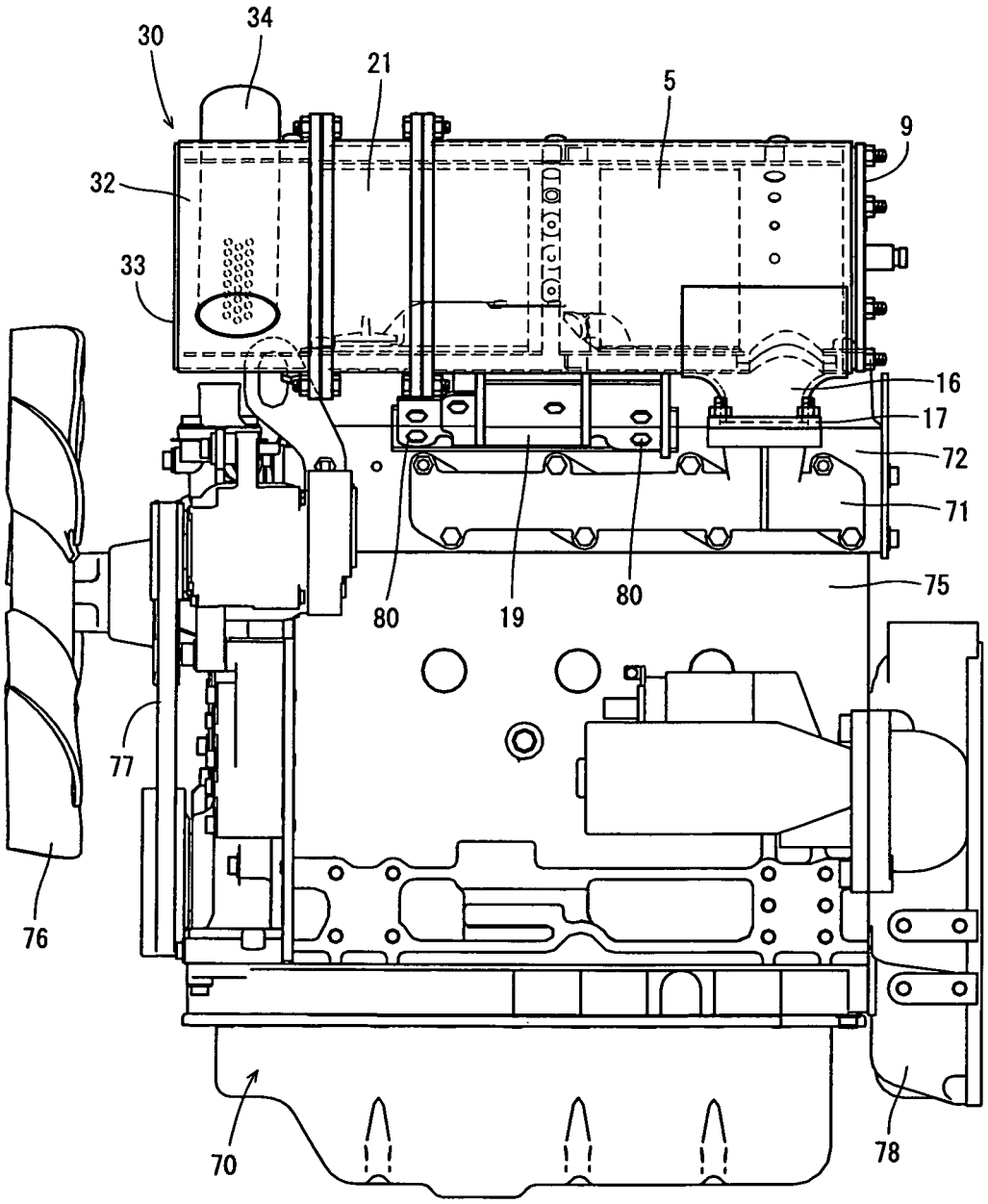
FIG. 15 is a left side elevational view of a diesel engine.
Figure 16:
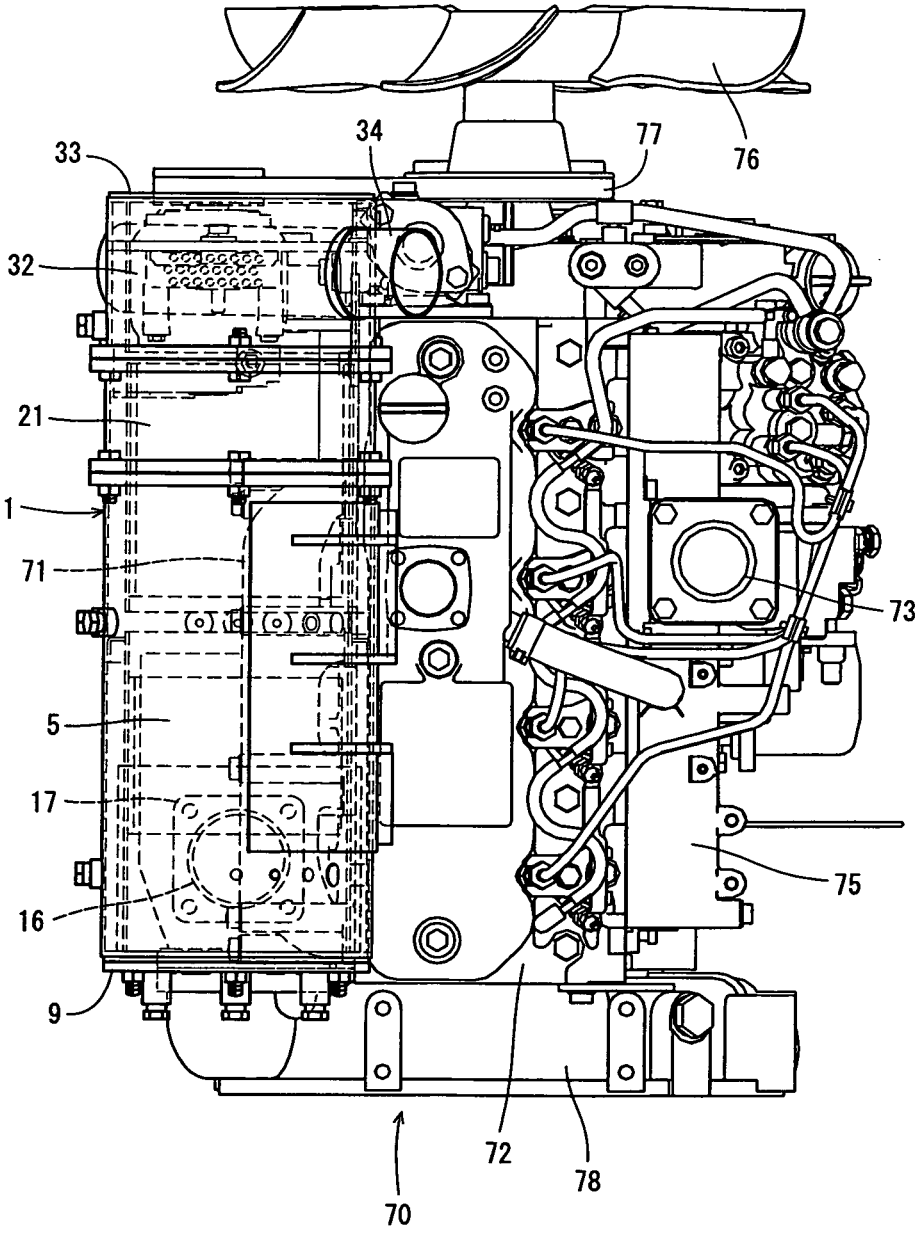
FIG. 16 is a plan view of the diesel engine.
Figure 17:
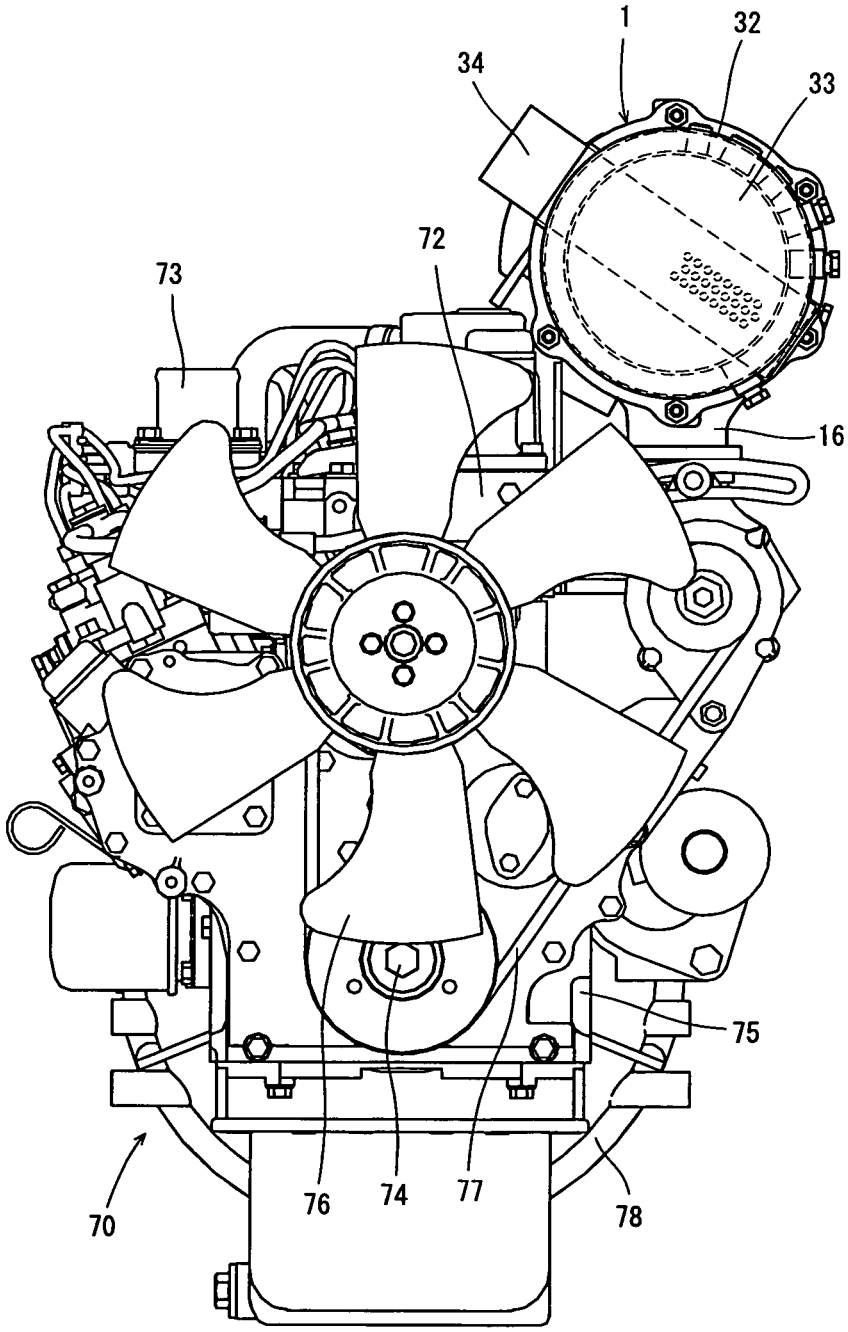
FIG. 17 is a front elevational view of the diesel engine.
Figure 18:
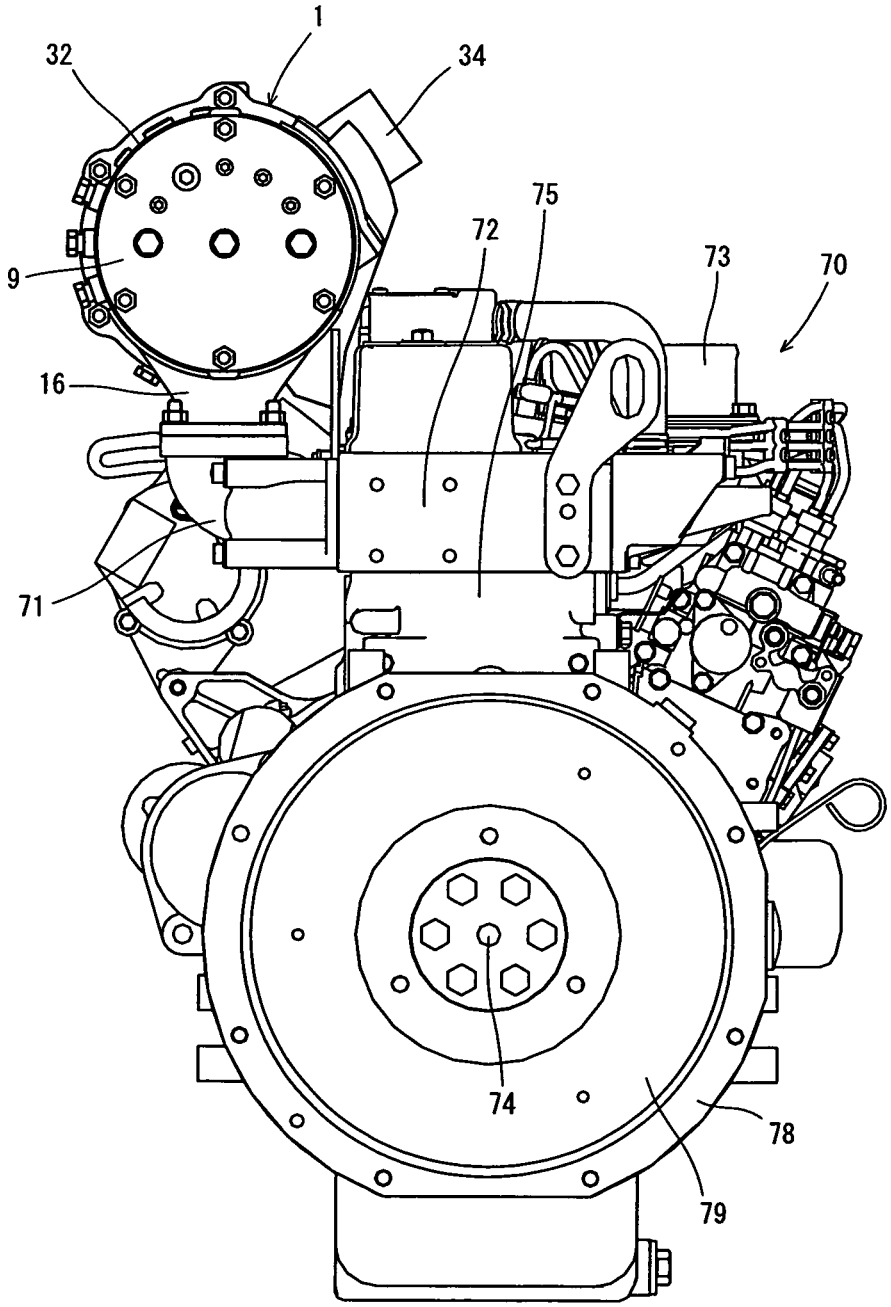
FIG. 18 is a back elevational view of the diesel engine.

Further, as shown in FIG. 18, a flywheel housing 78 is firmly fixed to a rear face of the cylinder block 75. The flywheel housing 78 is internally provided with a flywheel 79. The flywheel 79 is pivoted to a rear end side of the engine output shaft 74. The structure is made such that a power of the diesel engine 70 is taken out to an operation portion such as a back hoe 100, a fork lift 120, or the like mentioned below via the flywheel 79. Further, as shown in FIG. 15, the support leg body 19 is detachably fastened to the cylinder head 72 by a bolt 80. The DPF 1 mentioned above is structured so as to be supported to the cylinder head 72 having a high rigidity via the support leg body 19.

Figure 19:
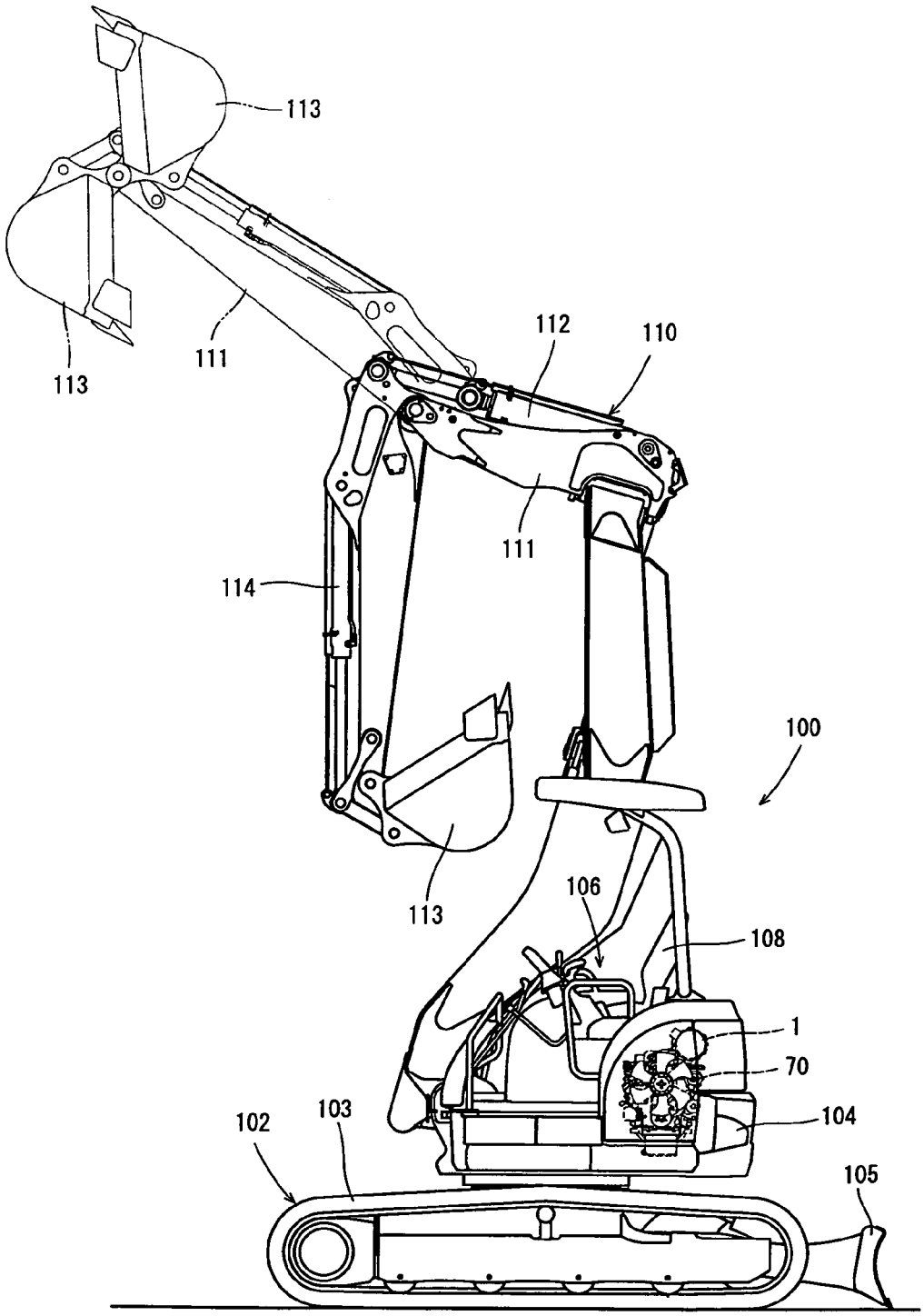
FIG. 19 is a side elevational view of a back hoe.
Figure 20:
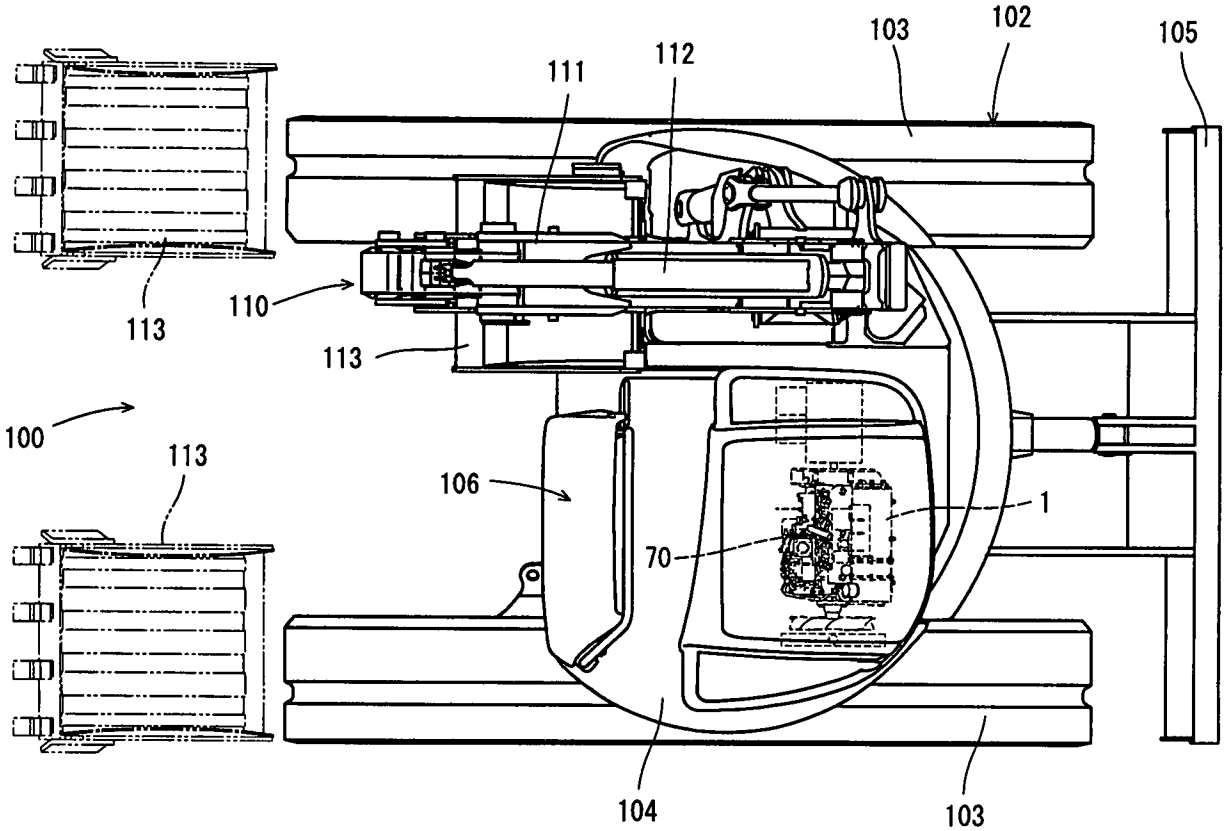
FIG. 20 is a plan view of the back hoe.

A structure in which the diesel engine 70 is mounted to the back hoe 100 will be described with reference to FIGS. 19 and 20. As shown in FIGS. 19 and 20, the back hoe 100 is provided with a crawler type traveling apparatus 102 having a pair of right and left traveling crawlers 103, and a swing machine body 104 provided on the traveling apparatus 102. The swing machine body 104 is structured such as to be horizontally swing over all directions of 360 degree, by a swinging hydraulic motor (not shown). A bulldozing blade 105 for a ground work is installed in a rear portion of the traveling apparatus 102 so as to be movable up and down. A control portion 106 and the diesel engine 70 are mounted to a left portion of the swing machine body 104. A working portion 110 having a boom 111 and a bucket 113 for an excavating work is provided in a right portion of the swing machine body 104.

In the control portion 106, there are arranged a control seat 108 on which an operator seats, operation means for operating an output of the diesel engine 70 or the like, and a lever or a switch serving an operation means for the working portion 110. A boom cylinder 112 and a bucket cylinder 114 are arranged in the boom 111 as a constituent element of the working portion 110. The bucket 113 serving as an excavating attachment is pivoted to a leading end portion of the boom 111 so as to be rotatable while scooping. The structure is made such that an earth work (a ground work such as a groove formation or the like) is executed with the bucket 113 by actuating the boom cylinder 112 or the bucket cylinder 114.

Figure 21:
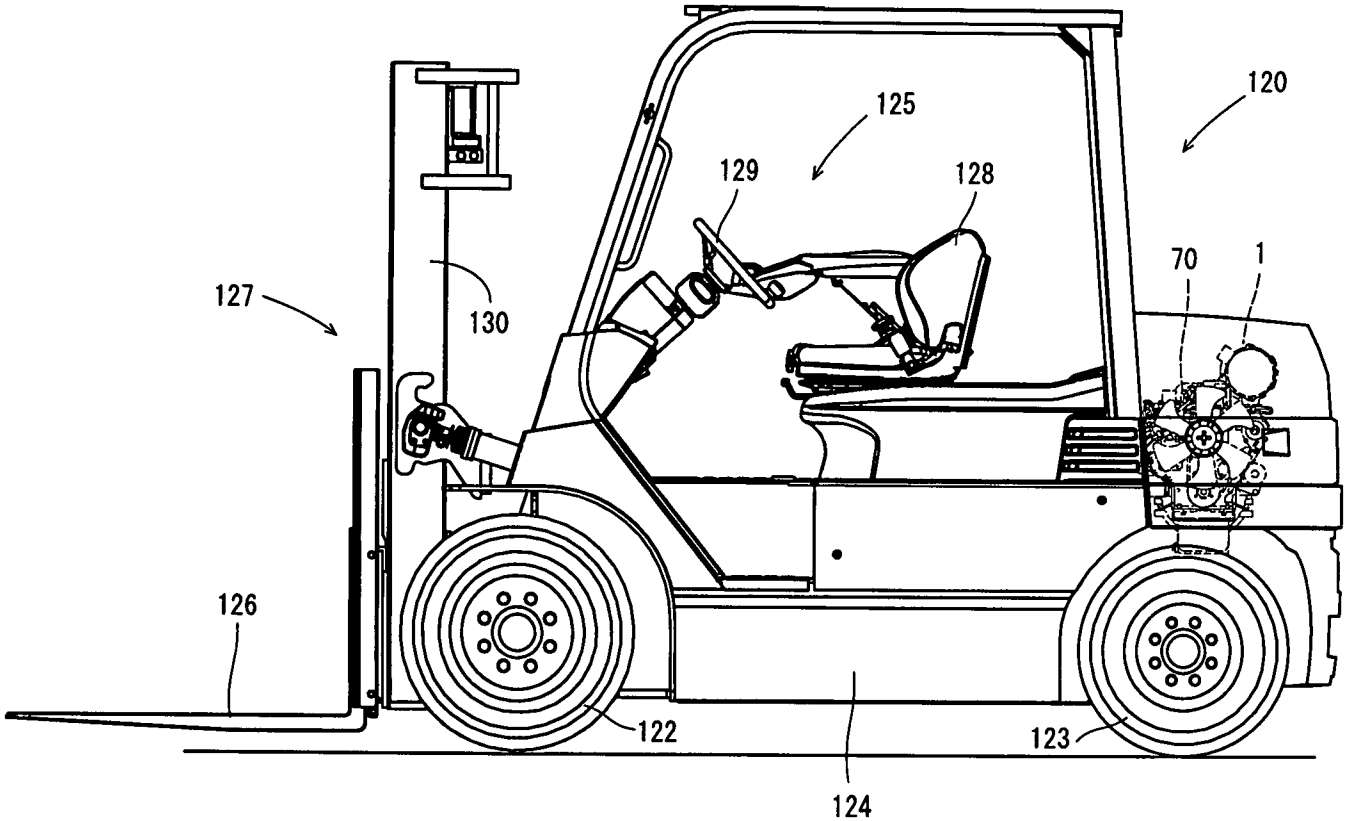
FIG. 21 is a side elevational view of a fork lift car.
Figure 22:
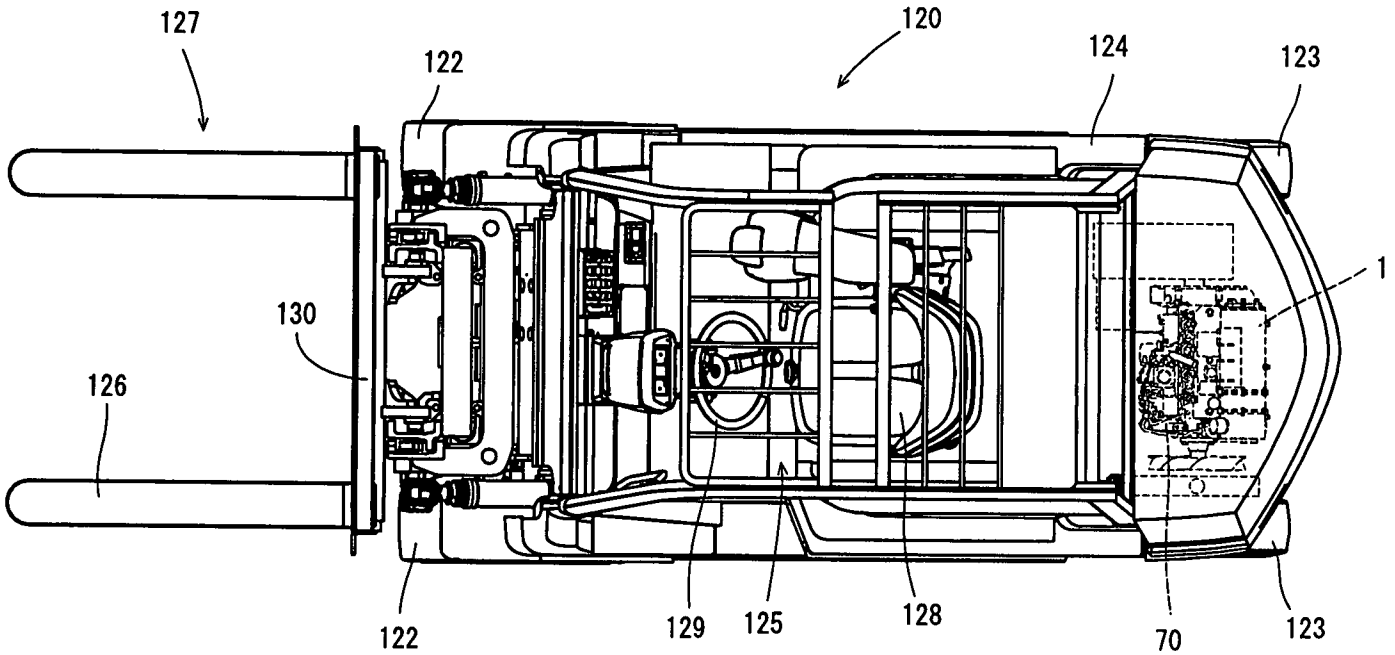
FIG. 22 is a plan view of the fork lift car.

A structure in which the diesel engine 70 is mounted to a fork lift car 120 will be described with reference to FIGS. 21 and 22. As shown in FIGS. 21 and 22, the fork lift car 120 is provided with a traveling machine body 124 having a pair of right and left front wheels 122 and rear wheels 123. A control portion 125 and the diesel engine 70 are mounted to the traveling machine body 124. A working portion 127 having a fork 126 for a cargo handling work is provided in a front portion of the traveling machine body 124 is provided with. In the control portion 125, there are arranged a control seat 128 on which the operator seats, a control handle 129, operation means for operating the output of the diesel engine 70 or the like, and a lever or a switch serving as the operation means for the working portion 127.

The fork 126 is arranged in a mast 130 as a constituent element of the working portion 127 so as to be movable up and down. The structure is made such that a cargo handling work, such as carrying a pallet (not shown) loading a cargo thereon, is executed by moving up and down the fork 126, mounting the pallet on the fork 126, and moving the traveling machine body 124 forward and backward.

REFERENCE NUMERALS

2 diesel oxidation catalyst (gas purifying filter)
3 soot filter (gas purifying filter)
4 catalyst inner case
5 catalyst outer case
7 inner case support body
**7*b*** outer case connection portion
11 exhaust gas inflow space (rectifying chamber)
12 exhaust gas inflow port
16 exhaust gas inlet pipe
19 support leg body (support body)
20 filter inner case
21 filter outer case

25 catalyst side flange (flange body)
26 filter side flange (flange body)
30 silencer
31 noise reduction inner case (silencer casing)
32 noise reduction outer case (silencer casing)
34 exhaust gas outlet pipe
36 exhaust hole
37 noise reduction hole
39 noise reduction material (exhaust noise damping body)
40 filter side outlet flange (flange body)
70 diesel engine

The invention claimed is:

1. An exhaust gas purifying device comprising:

a diesel oxidation catalyst and a soot filter for purifying an exhaust gas discharged from an engine;

a catalyst inner case for holding the diesel oxidation catalyst;

a filter inner case for holding the soot filter;

a catalyst outer case for holding the catalyst inner case; and a filter outer case for holding the filter inner case; and wherein a first flange is provided at an outer peripheral end of the catalyst outer case at a downstream side of a moving direction of the exhaust gas, and a second flange is provided at an outer peripheral end of the filter outer case in an upstream side of the moving direction of the exhaust gas;

wherein in a state where the catalyst outer case and the filter outer case are connected via the first and second flanges, an end of the filter inner case in the upstream side of the moving direction of the exhaust gas is apart from by a space and faces an end of the catalyst inner case in the downstream side of the moving direction of the exhaust gas;

wherein in said state the first and second flanges are at axially offset positions with respect to said space between the end of the catalyst inner case in the downstream side of the moving direction of the exhaust gas and the end of the filter inner case in the upstream side of the moving direction of the exhaust gas; and wherein one inner case of the catalyst inner case and the filter inner case overlaps with one outer case among the catalyst outer case and the filter outer case, said one outer case holding the other inner case of said catalyst inner case and said filter inner case.

2. The exhaust gas purifying device according to claim 1, comprising an exhaust noise damping body for damping an exhaust noise of the exhaust gas discharged from the engine, wherein the exhaust noise damping body is arranged in an exhaust gas outlet side end portion of the filter outer case.

3. The exhaust gas purifying device according to claim 1, wherein an inlet pipe is arranged on an outer side of the catalyst outer case, an exhaust gas inlet is open to the catalyst inner case and the catalyst outer case so as to be opposed to an exhaust gas outlet side of said inlet pipe, a rectifying chamber is formed between an end face of the catalyst outer case in the upstream side in the moving direction of the exhaust gas and an end face of the diesel oxidation catalyst, and the rectifying chamber is communicated with the inlet pipe via the exhaust gas inlet.

4. The exhaust gas purifying device according to claim 1, wherein an exhaust gas inlet is formed in a peripheral surface close to one end of the catalyst inner case and the catalyst outer case, an inlet pipe is arranged in an outer side of the exhaust gas inlet in an outer periphery of the catalyst outer case, and an area of an opening end face close to an exhaust gas outlet of said inlet pipe is formed larger than an area of an opening end face close to the exhaust gas inlet of said inlet pipe.

* * * * *